US005620535A

United States Patent [19]

Inoue et al.

[11] Patent Number: 5,620,535

[45] **Date of Patent: *Apr. 15, 1997**

[54] ALLOY SHEET FOR SHADOW MASK

[75] Inventors: Tadashi Inoue; Kiyoshi Tsuru; Michihito Hiasa; Tomoyoshi Okita, all of Kawasaki, Japan

[73] Assignee: NKK Corporation, Tokyo, Japan

[ * ] Notice: The term of this patent shall not extend beyond the expiration date of Pat. No. 5,456,771.

[21] Appl. No.: 160,399

[22] Filed: Dec. 1, 1993

Related U.S. Application Data

[63] Continuation-in-part of Ser. No. 7,755, Jan. 22, 1993, Pat. No. 5,456,771.

[30] Foreign Application Priority Data

| | | | |
|---|---|---|---|
| Jan. 24, 1992 | [JP] | Japan | 4-032941 |
| May 31, 1993 | [JP] | Japan | 5-152885 |
| Jul. 27, 1993 | [JP] | Japan | 5-184938 |

[51] Int. Cl.[6] ..... H01F 1/04

[52] U.S. Cl. ..... 148/311; 148/310; 420/94; 420/95; 420/97

[58] Field of Search ..... 148/310, 311; 420/94, 95, 97

[56] References Cited

U.S. PATENT DOCUMENTS

| | | | |
|---|---|---|---|
| 4,724,012 | 2/1988 | Inaba et al. | 420/43 |
| 4,751,424 | 6/1988 | Tong et al. | 313/402 |
| 5,127,965 | 7/1992 | Inoue et al. | 148/500 |
| 5,158,624 | 10/1992 | Okiyama et al. | 148/310 |
| 5,207,844 | 5/1993 | Watanabe et al. | 148/546 |
| 5,234,512 | 8/1993 | Inoue et al. | 148/541 |
| 5,234,513 | 8/1993 | Inoue et al. | 148/541 |
| 5,308,723 | 5/1994 | Inoue et al. | 430/23 |

FOREIGN PATENT DOCUMENTS

| | | |
|---|---|---|
| 0104453 | 4/1984 | European Pat. Off. . |
| 0174196 | 3/1986 | European Pat. Off. . |
| 0552800 | 7/1993 | European Pat. Off. . |
| 0561120 | 9/1993 | European Pat. Off. . |
| 2664908 | 1/1992 | France . |

(List continued on next page.)

OTHER PUBLICATIONS

Chemical Abstracts, p. 249, No. 133956d of JP–A–60 251 227, vol. 104, No. 16, Apr. 21, 1986.

(List continued on next page.)

*Primary Examiner*—John Sheehan

*Attorney, Agent, or Firm*—Frishauf, Holtz, Goodman, Langer & Chick, P.C.

[57] ABSTRACT

An alloy sheet for making a shadow mask consists essentially of 34 to 38 wt. % Ni, 0.07 wt. % or less Si, 0.002 wt. % or less B, 0.002 wt. % or less O, less than 0.002 wt. % N and the balance being Fe and inevitable impurities;

said alloy sheet after annealing before press-forming having 0.2% proof stress of 28 kgf/mm$^2$ or less; and a gathering degree of {211} plane being 16% or less.

A method for manufacturing an alloy sheet comprises:

a finish cold-rolling step of cold-rolling the cold-rolled sheet at a cold-rolling reduction ratio in response to an average austenite grain size D (μm), the reduction ratio of final cold-rolling R (%) satisfying the equations below;

$$16 \leqq R \leqq 75,$$

$$6.38D-133.9 \leqq R \leqq 6.38D-51.0$$

a softening annealing step of annealing said cold rolled sheet in a temperature range of 720° to 790° C. for 2 to 40 min. before press-forming and on conditions satisfying the equation below;

$$T \geqq -53.8 \log t + 806,$$

where T(° C.) is the temperature and t (min.) is the time of the annealing.

72 Claims, 9 Drawing Sheets

FOREIGN PATENT DOCUMENTS

| | | |
|---|---|---|
| 2668498 | 4/1992 | France . |
| 3545354 | 7/1986 | Germany . |
| 3636815 | 5/1987 | Germany . |
| 3642205 | 1/1988 | Germany . |
| 59-59861 | 4/1984 | Japan . |
| 61-19737 | 1/1986 | Japan . |
| 61-113747 | 5/1986 | Japan . |
| 63-259054 | 10/1988 | Japan . |
| 64-52024 | 2/1989 | Japan . |
| 3-197645 | 8/1991 | Japan . |
| 3-267320 | 11/1991 | Japan . |
| WO91/12345 | 8/1991 | WIPO . |

OTHER PUBLICATIONS

Database WPIL, Week 8732, Derwent Publications Ltd., London, GB; AN 87–224995; abstract of JP–A–62 149 851.

Database WPIL, Week 8615, Derwent Publications Ltd., London, GB; AN 86–098295; abstract of JP–A–61 044 126.

Database WPIL, Week 8610, Derwent Publications Ltd., London, GB; AN 86–066609; abstract of JP–A–61 019 737.

Patent Abstracts of Japan, vol. 10, No. 296 (C–377), Oct. 8, 1986, of JP 61 113 747 (Nippon Mining Co., Ltd.), May 31, 1986.

Patent Abstracts of Japan, vol. 15, No. 461 (C–0887), Nov. 22, 1991 of JP 03 197 645 (Nippon Mining Co., Ltd.), Aug. 29, 1991.

Patent Abstracts of Japan, vol. 13, No. 69 (C–569), Feb. 16, 1989 of JP 63 259 054 (Nippon Mining Co., Ltd.), Oct. 26, 1988.

Patent Abstracts of Japan, vol. 10, No. 296 (C–377), Oct. 8, 1986, of JP 61 113 746 (Nippon Mining Co., Ltd.), May 31, 1986.

Patent Abstracts of Japan, vol. 15, No. 92 (C–0811), Mar. 6, 1991, of JP 02 305 941 (Toyo Kohan Co., Ltd.), Dec. 19, 1990.

Patent Abstracts of Japan, vol. 15, No. 461 (C–0887), Nov. 22, 1991, of JP 03 197 646 (Nippon Mining Co., Ltd.), Aug. 29, 1991.

ALLOY SHEET FOR SHADOW MASK

CROSS REFERENCE TO RELATED APPLICATION

This is a continuation-in-part-application of Serial No. 08/007,755 filed on Jan. 22, 1993 (now U.S. Pat. No. 5,456,711), which is incorporated herein in its entirety by reference.

BACKGROUND OF THE INVENTION

1. Field of the Invention

The present invention relates to an alloy sheet for making a shadow mask having high press-formability and method for manufacturing thereof.

2. Description of the Related Art

Recent up-grading trend of color television toward high definition TV has employed Fe—Ni alloy containing 34 to 38 wt. % Ni as the alloy for making a shadow mask to suppress color-phase shift. Compared with low carbon steel which has long been used as a shadow mask material, conventional Fe—Ni alloy has considerably lower thermal expansion coefficient. Accordingly, a shadow mask made of conventional Fe—Ni alloy raises no problem of color-phase shift coming from the thermal expansion of shadow mask even when an electron beam heats the shadow mask.

Common practice of making the alloy sheet for shadow mask includes the following steps. An alloy ingot is prepared by continuous casting process or ingot-making process. The alloy ingot is subjected to slabbing, hot-rolling, cold-rolling, and annealing to form a alloy sheet.

The alloy sheet for the shadow mask is then processed usually in the following steps to form shadow mask. (1) The alloy sheet is photo-etched to form passage-holes for the electron beam on the alloy sheet for shadow mask. The thin alloy sheet for shadow mask perforated by etching is hereinafter referred to as "flat mask". (2) The flat mask is subjected to annealing. (3) The annealed flat mask is pressed into a curved shape of cathode ray tube. (4) The press-formed flat mask is assembled to a shadow mask which is then subjected to blackening treatment.

The shadow mask which is prepared by cold-rolling, recrystallization annealing, or by further slight finishing rolling after recrystallization annealing, has higher strength than conventional low carbon steel. Accordingly, such a conventional Fe—Ni alloy is subjected to softening-annealing (annealing before press-forming) at a temperature of 800° C. or more before press-forming to make grains coarse. After the softening-annealing, an warm-press is applied to carry spheroidal forming. The temperature of 800° C. or more is, however, in a high temperature region. Therefore, from the view point of work efficiency and economy, the development of manufacturing method to obtain such a low strength as in the material, which is softening-annealed at 800° C. or more, by the softening-annealing at 800° C. or less has been waited. Responding to the request, a prior art was proposed in JP-A-H3-267320 (the term JP-A- referred to herein signifies unexamined Japanese patent publication ). The prior art employs cold-rolling, recrystallization annealing, finish cold-rolling and softening annealing. The finish cold-rolling is conducted at a reduction ratio of 5 to 20%. The temperature of the softening annealing is below 800° C., more specifically at 730° C. for 60 min. The prior art produces a sheet having sufficiently low strength to give good press-forming performance with the 0.2% proof stress of 9.5 kgf/mm$^2$ (10 kgf/mm$^2$ or less) at 200° C.

However, the prior art does not satisfy the quality required to perform a favorable warm press-forming. Shadow masks prepared by the prior art were found to gall the die and to,generate cracks at the edge of shadow masks.

Nevertheless, cathode ray tube manufacturers try to carry the softening annealing at a lower temperature and in a shorter time than conventional level described above aiming to improve work efficiency and economy. The target annealing time is 40 min. or less, and in some cases, as short as 2 min. However, if such an annealing condition is applied to the prior art, the galling of dies during press-forming becomes severe and the crack on shadow mask increases to raise serious quality problem.

SUMMARY OF THE INVENTION

The object of the present invention is to provide an alloy sheet for making a shadow mask having high press-formability and method for manufacturing thereof. To achieve the object, the present invention provides an alloy sheet for making a shadow mask consisting essentially of 34 to 38 wt. % Ni, 0.07 wt. % or less Si, 0.002 wt. % or less B, 0.002 wt. % or less O, less than 0.002 wt. % N and the balance being Fe and inevitable impurities;

said alloy sheet after annealing before press-forming having 0.2% proof stress of 28 kgf/mm$^2$ or less; and a gathering degree of {211} plane on a surface of said alloy sheet being 16% or less.

Said alloy steel sheet may further include 1 wt. % or less Co.

The present invention also provides an alloy sheet for making a shadow mask consisting essentially of 28 to 38 wt. % Ni, 0.07 wt. % or less Si, 0.002 wt. % or less B, 0.002 wt. % or less O, less than 0.002 wt. % N, over 1 to 7 wt. % Co, and the balance being Fe and inevitable impurities;

said alloy sheet after annealing before press-forming having 0.2% proof stress of 28 kgf/mm$^2$ or less; and a gathering degree of {211} plane on a surface of said alloy sheet being 16% or less.

The present invention also provides an alloy sheet for making a shadow mask consisting essentially of 34 to 38 wt. % Ni, 0.1 wt. % or less Si, 0.003 wt. % or less B, 0.003 wt. % or less O, less than 0.002 wt. % N, 0.05 to 3 wt. % Cr and the balance being Fe and inevitable impurities;

said alloy sheet after annealing before press-forming having 0.2% proof stress of 27.5 kgf/mm$^2$ or less; and a gathering degree of {211} plane on a surface of said alloy sheet being 16% or less.

Said alloy steel sheet may further include 1 wt. % or less Co.

The present invention also provides an alloy sheet for making a shadow mask consisting essentially of 28 to 38 wt. % Ni, 0.1 wt. % or less Si, 0.003 wt. % or less B, 0.003 wt. % or less O, less than 0.002 wt. % N, 0.05 to 3 wt. % Cr, over 1 to 7 wt. % Co, and the balance being Fe and inevitable impurities;

said alloy sheet after annealing before press-forming having 0.2% proof stress of 27.5 kgf/mm$^2$ or less; and a gathering degree of {211} plane on a surface of said alloy sheet being 16% or less.

The present invention also provides a method for manufacturing an alloy sheet for shadow mask comprising the steps of:

(a) preparing a hot rolled-sheet containing Fe and Ni;

(b) annealing said hot-rolled sheet in a temperature range of 910° to 990° C.;

(c) a first cold-rolling step of cold-rolling said annealed hot-rolled sheet to produce a cold-rolled sheet:

(d) a first crystallization annealing step of annealing said cold-rolled sheet subjected to the first cold-rolling;

(e) a second cold-rolling step of cold-rolling said cold rolled sheet subjected to the recrystallization annealing;

(f) a final recrystallization annealing step of annealing said cold-rolled sheet subjected to the second cold-rolling;

(g) a finish cold-rolling step of cold-rolling the cold-rolled sheet subjected to the finish recrystallization annealing at a cold-rolling reduction ratio in response to an average austenite grain size D (μm) yieleded by the finishing recrystallization annealing, the reduction ratio of final cold-rolling R (%) satisfying the equations below;

$$16 \leqq R \leqq 75,$$

$$6.38D-133.9 \leqq R \leqq 6.38D-51.0$$

(h) a softening annealing step of annealing said cold rolled sheet subjected to the finishing cold-rolling in a temperature range of 720° to 790° C. for 2 to 40 min. before press-forming and on conditions satisfying the equation below;

$$T \geqq -53.8 \log t+806,$$

where T(°C.) is the temperature and t (min.) is the time of the annealing.

Said hot-rolled sheet can be a hot-rolled sheet containing Ni and Co.

The present invention further provides a method for manufacturing an alloy sheet for shadow mask comprising the steps of:

(a) preparing a hot-rolled sheet containing Fe, Ni and Cr;

(b) annealing said hot-rolled sheet in a temperature range of 910° to 990° C.;

(c) cold-rolling said annealed hot-rolled sheet to produce a cold-rolled sheet:

(d) a final recrystallization annealing step of annealing said cold-rolled sheet subjected to the cold-rolling;

(e) a finish cold-rolling step of cold-rolling the cold-rolled sheet subjected to the final recrystallization annealing at the cold-rolling reduction ratio in response to an average austenite grain size D (μm) yieleded by the final recrystallization annealing, the cold-rolling reduction ratio R (%) satisfying the equations below;

$$16 \leqq R \leqq 75,$$

$$6.38D-133.9 \leqq R \leqq 6.38D-51.0$$

(f) a stress relief annealing step of annealing the cold-rolled sheet subjected to the finish cold rolling;

(g) a softening annealing step of annealing said cold-rolled sheet subjected to the finish cold-rolling in a temperature range of 700° to less than 800° C. for 0.5 to less than 60 min. before press-forming and on conditions satisfying the equation below;

$$T \geqq -48.1 \log t+785,$$

where T(°C.) is the temperature and t (min.) is the time of the annealing.

Said hot-rolled sheet can be a hot-rolled sheet containing Fe, Ni, Co and Cr.

The term favorable press-formability of the present invention means to have an excellent shape freezing performance, to have a good fitness to dies (free of galling of dies), and to generate no crack on material during press-forming.

DESCRIPTION OF THE PREFERRED EMBODIMENTS

Preferred embodiment-1

Figure 1:
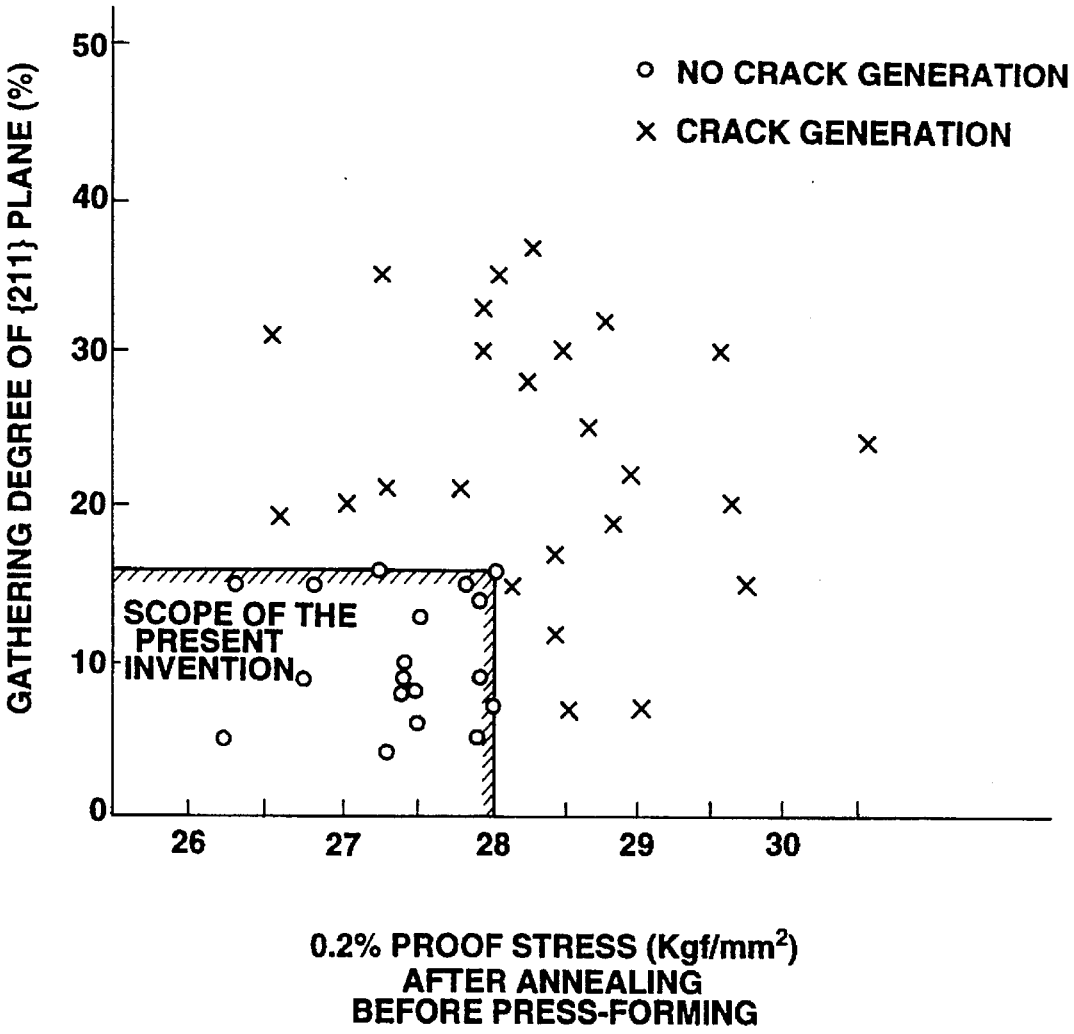
FIG. 1 is a graph showing a relationship among 0.2% proof stress after the annealing before press-forming, gathering degree of {211} plane and crack generation during press-forming according to the preferred embodiment-1.

The present invention requests a specific range of yield strength in order to improve the shape fix ability during hot press-forming and to suppress the crack generation on alloy sheet. The yield strength is represented by 0.2% proof stress of 28.0 kgf/mm$^2$ at the room temperature after softening annealing before press-forming (hereinafter referred to as "annealing before pressforming"). 0.2% proof stress of 28.0 kgf/mm$^2$ or less further improves the shape fix ability.

The gist of the present invention is as follows.

(a), Growth of the crystal grain is enhanced during the annealing before press-forming by specifying the content of B and O. Coarsening of crystal grain realizes a low yield strength.

(b), Fitness to dies during press-forming is improved by specifying the content of Si and N to suppress galling of dies.

(c), Generation of crack during press-forming is suppressed by controlling degree of {211} plane on the thin alloy sheet after the annealing before press-forming.

The invention is described to a greater detail in the following with the reasons to limit the range of the chemical composition of the alloy.

To prevent color-phase shift, the Fe—Ni alloy sheet for shadow mask is necessary to have the upper limit of average thermal expansion coefficient at approximately $2.0\times10^{-6}$ /° C. in the temperature range of 30° to 100° C. The average thermal expansion coefficient depends on the content of Ni in the alloy sheet. The Ni content which satisfies the above limitation of average thermal expansion coefficient is in a range of 34 to 38 wt. %. Consequently, the preferred Ni content is in a range of 34 to 38 wt. %. More preferably, the Ni content to further decrease average thermal expansion coefficient is in a range of 35 to 37 wt. %, and most preferably in a range of 35.5 to 36.5 wt. %. Usually Fe—Ni alloy includes Co as inevitable impurities. Co of 1 wt. % or less does not affect the characteristics. Ni content which satisfies the above described range is also employed. On the contrary, when over 1 wt. % to 7 wt. % Co is included, the Ni content which satisfies the above limitation of average thermal expansion coefficient is in a range of 28 to 38 wt. %. Consequently, the Ni content is specified as 28 to 38 wt. % when over 1 wt. % to 7 wt. % Co is included. Co and Ni content to further improve the characteristics is in a range of 3 to 6 and 30 to 33 wt. %, respectively. As Co of over 7 wt. % increases the thermal expansion coefficient, the upper limit of Co content is defined as 7 wt. %.

Oxygen is one of the inevitable impurities. When oxygen content is increased, the non-metallic oxide inclusion increases in the alloy. The non-metallic inclusion suppresses the growth of crystal grains during the annealing before press-forming, particularly under the condition of 720° to 790° C. and 40 min or less annealing, which is the condition before press-forming specified in this invention. If the content of O exceeds 0.002%, the growth of crystal grains is suppressed and 0.2% proof stress after the annealing before press-forming exceeds 28.0 kgf/mm$^2$. The lower limit of O content is not specially limited, but it is selected to 0.001% from the economy of ingot-making process.

Boron enhances the hot-workability of the alloy. Excess amount of B induces the segregation of B at boundary of recrystallized grain formed during the annealing before press-forming, which inhibits the free migration of grain boundaries and results in the suppression of grain growth and the dissatisfaction of 0.2% proof stress after the annealing before press-forming. In particular, under the annealing condition before press-forming, which is specified in this invention, the suppression action against the grain growth is strong and the action does not uniformly affect on all grains, so a severe mixed grain structure is accompanied with irregular elongation of material during press-forming. Boron also increases the gathering degree of {211} plane after annealing, which causes the crack on the skirt of material. Boron content above 0.0020 wt. % significantly enhances the suppression of grain growth, and the 0.2% proof stress exceeds 28.0 kgf/mm$^2$. Also the irregular elongation during press-forming appears, and the degree of {211} plane exceeds the upper limit specified in this invention. Based on these findings, the upper limit of B content is defined as 0.0020 wt. %.

Silicon is used as the deoxidizer during ingot-making of the alloy. When the Si content exceeds 0.07 wt. %, an oxide film of Si is formed on the surface of alloy during the annealing before press-forming. The oxide film degrades the fitness between die and alloy sheet during press-forming and results in the galling of die by alloy sheet. Consequently, the upper limit of Si content is specified as 0.07 wt. %. Less Si content improves the fitness of die and alloy sheet. The lower limit of Si content is not necessarily specified but practical value is 0.001 wt. % or more from the economy of ingot-making process.

Nitrogen is an element unavoidably entering into the alloy during ingot-making process. 0.0020 wt. % or more nitrogen induces the concentration of N on the surface of alloy during the annealing before press-forming. The concentrated N on the surface of alloy degrades the fitness of die and alloy sheet to gall die with the alloy sheet. Consequently, N content is specified below 0.0020 wt. %. Although the lower limit of N content is not necessarily defined, the practical value is 0.0001 wt. % or higher from the economy of ingot-making process.

Most preferably, the composition further contains 0.0001 to 0.005 wt. % C, 0.001 to 0.35 wt. % Mn, and 0.001 to 0.05 wt. % Cr.

As described above, the control of alloy composition and of 0.2% proof stress after the annealing before press-forming specified in this invention suppresses the galling of dies by alloy sheet during press-forming and gives a superior shape fix ability. However, regarding to press-forming quality, there remains the problem of crack generation on press-formed material. To cope with the problem, the inventors studied the relation between the crack generation on the material during press-forming and the crystal orientation during press-forming by changing the crystal orientation of the alloy sheet in various directions using the alloy sheets having chemical composition and 0.2% proof stress in the range specified in this invention, and found that an effective condition to suppress the crack generation on the alloy material is to control the gathering degree of {211} plane to maintain at or below a specified value, as well as to control the 0.2% proof stress after the annealing before press-forming to keep at or below a specified level.

FIG. 1 shows the relation among crack generation on alloy sheet during press-forming, gathering degree of {211} plane, and 0.2% proof stress for an alloy sheet having chemical composition specified in the present invention. The gathering degree of {211} plane is determined from the relative X-ray intensity ratio of (422) diffraction plane of alloy sheet after the annealing before press-forming divided by the sum of relative X-ray diffraction intensity ratio of (111), (200), (220), (311), (331), and (420) diffraction planes. The relative X-ray diffractive intensity ratio is defined as the value of X-ray diffraction intensity observed on each diffraction plane divided by the theoretical X-ray diffraction intensity of that diffraction plane. For example, the relative X-ray diffraction intensity ratio of (111) diffraction plane is determined from the X-ray diffraction intensity of (111) diffraction plane divided by the theoretical X-ray diffraction intensity of (111) diffraction plane. The measurement of degree of {211} plane was carried by measuring the X-ray diffraction intensity of (422) diffraction plane which has equivalent orientation with {211} plane.

FIG. 1 clearly shows that the case where 0.2% proof stress does not exceed 28.0 kgf/mm$^2$ and where the gathering degree of {211} plane does not exceed 16% does not induce crack generation on alloy sheet during press-forming, which fact indicates the effect of this invention. Based on the finding, the invention specifies 16% or less of the gathering degree of {211} plane as the condition to suppress crack generation on the alloy sheet.

The alloy sheet of the present invention is manufactured by the following processes. The hot-rolled alloy sheet having the above described chemical composition is annealed, subjected to the process including cold-rolling, recrystallization annealing and cold-rolling, followed by final recrystallization annealing, finish cold-rolling and annealing before press-forming.

Figure 2:
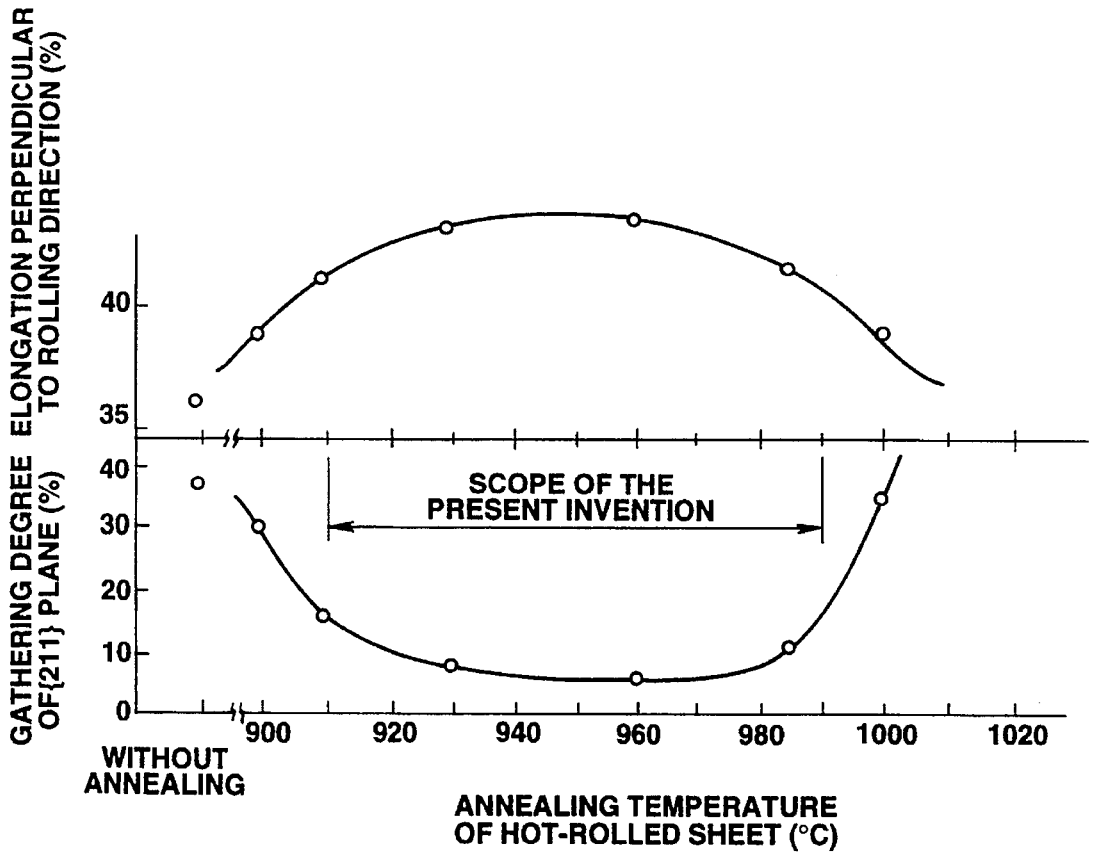
FIG. 2 is a graph showing a relationship among the gathering degree of {211} plane, elongation perpendicular to rolling direction and the annealing temperature of the hot-rolled sheet according to the preferred embodiment-1.

The processes will be described in detail. The hot-rolled sheet is needed to be annealed in the specified temperature range to maintain the gathering degree of {211} plane of 16% or less. The hot-rolled sheet which satisfies the condition of chemical component specified in the present invention is annealed at different temperatures, subjected to the process including cold-rolling, recrystallization annealing, cold-rolling, recrystallization annealing (at 890° C. for 1 min.), finish cold-rolling (at 21% of reduction ratio) and annealing before press-forming to obtain the desired alloy sheet. As a comparative example, a hot-rolled strip not annealed was treated under the same condition as thereabove. FIG. 2 shows the relation among the gathering degree of {211} plane, elongation perpendicular to rolling direction, and annealing temperature of the alloy sheet treated by the processes above. According to FIG. 2, the gathering degree of {211} plane gave 16% or less when the annealing temperature of the hot-rolled sheet is 910° to 990° C. Consequently, this invention specifies the temperature of annealing of hot-rolled sheet in the range of 910° to 990° C. to assure the gathering degree of {211} plane of 16% or less.

To acquire the satisfactory gathering degree of {211} plane being focused on in this invention, the uniform heat treatment of the slab after slabbing is not preferable. For example, when a uniform heat treatment is carried at 1200° C. or more for 10 hours or more, the gathering degree of {211} plane exceeds the range specified in the present invention. Therefore, such a heat treatment must be avoided.

The mechanism of crack generation during press-forming under the condition of above 16% of the degree of crystal plane is not clear. FIG. 2 shows the trend that a high degree of {211} plane gives a low elongation perpendicular to the rolling direction. Increased degree of {211} plane decreases the elongation perpendicular to the rolling direction and lowers the fracture limit, then presumably induces cracks.

To keep the gathering degree of {211} plane at 16% or less and to maintain the 0.2% proof stress after the annealing before press-forming at 28.0 kgf/mm$^2$ or less, the control of the condition of finish cold rolling (reduction ratio of finish cold-rolling), and of condition of the annealing before press-forming are important, also.

Figure 3:
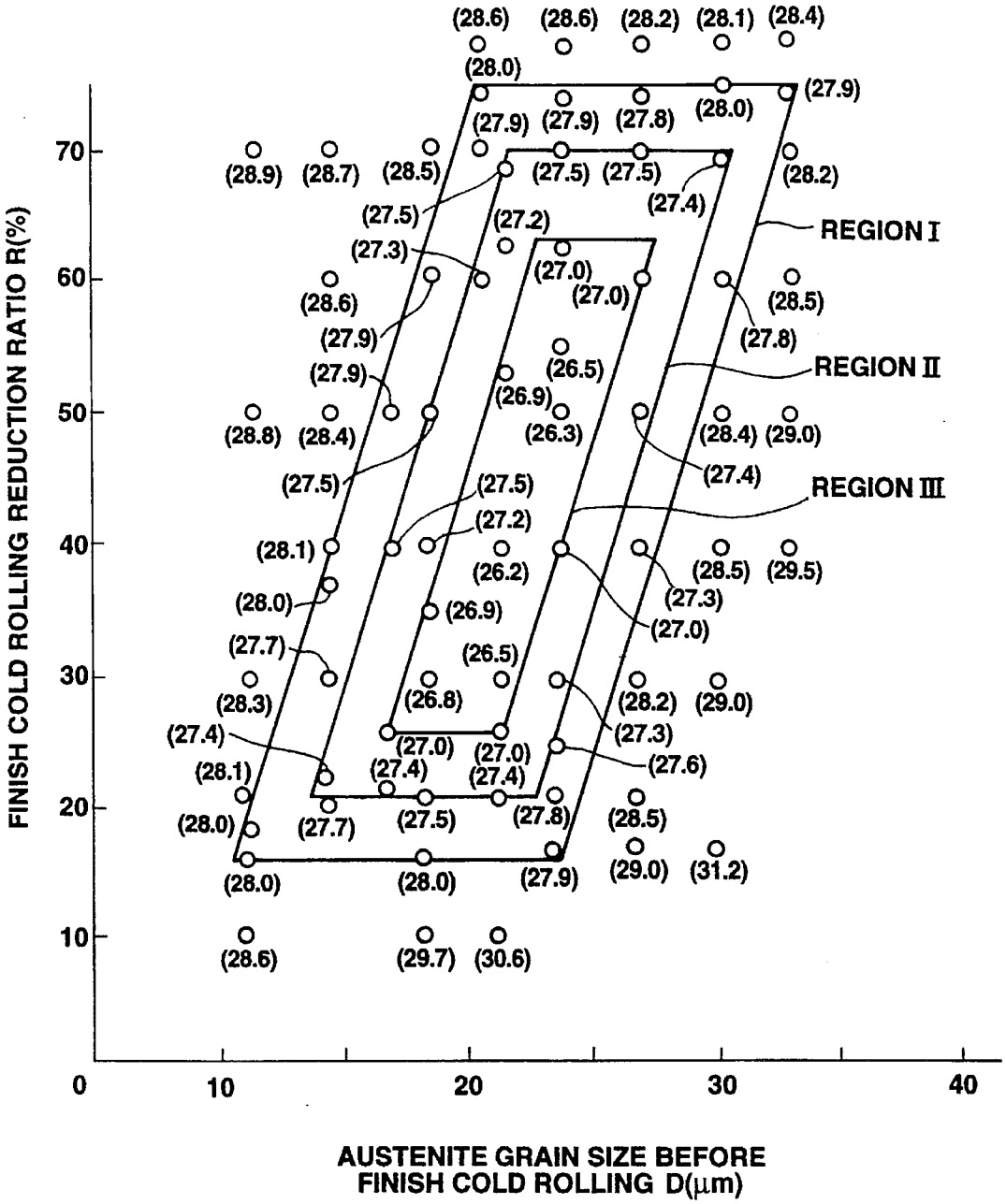
FIG. 3 is a graph showing a relationship among average austenite grain size before finishing cold-rolling, finish cold-rolling reduction ratio and 0.2% proof stress after the annealing before press-forming according to the preferred embodiment-1.

The hot-rolled alloy strip having the composition thereabove was subjected to annealing (in the temperature range of 910° to 990° C.), cold-rolling, recrystallization annealing, finishing cold-rolling, and annealing before press-forming (at 750° C. for 15 min.) to produce the alloy sheet. The alloy sheet was tested for tensile strength to determine 0.2% proof stress (the value is shown in the parenthesis in FIG. 3). FIG. 3 shows the relation among the 0.2% proof stress, reduction ratio of finish cold-rolling and average austenite grain size before finish cold-rolling. In this test, the specified austenite grain size was obtained by varying the temperature of recrystallization annealing before finish cold-rolling.

The 0.2% proof stress of 28.0 kgf/mm$^2$ or less is obtained as is shown in region I of FIG. 3 under the conditions given below. Finish cold-rolling reduction ratio (R%): 16–75%, 6.38D−133.923 R≦6.38D−51.0, D is average austenite grain size (μm) before finish cold-rolling. The reduction ratio (R%) is controlled based on the average grain size (D μm).

In the case of R<16% or R<6.38D−133.9, the condition specified in the present invention for the annealing before press-forming gives insufficient recrystallization, insufficient growth of recrystallized grain, and 0.2% proof stress exceeding 28.0 kgf/mm$^2$, and results in a dissatisfactory alloy sheet. If R>75 % or R>6.38D−51.0, then the condition specified in the present invention for the annealing before press-forming allows 100% recrystallization but gives excess frequency of nucleation during recrystallization, which decreases the size of recrystallized grain. In that case, the 0.2% proof stress exceeds 28.0 kgf/mm$^2$, and the alloy sheet has unsatisfactory quality.

From the above described reasons, the condition to achieve 28.0 kgf/mm$^2$ or below of 0.2% proof stress under the condition of the annealing before press-forming in this invention is specified as R (%), the reduction ratio of cold-rolling, which satisfies the equations of (1a) and (1b) being described below according to the average austenite grain size before finish cold-rolling.

$$16 \leqq R \leqq 75 \quad (1a)$$

$$6.38D-133.9 \leqq R \leqq 6.38D-51.0 \quad (1b)$$

An adequate value of the reduction ratio of finish cold-rolling (R%) in response to the austenite grain size (D μm) before finish cold-rolling within the range specified above realize the gathering degree of {211} plane of 16% or less on the surface of alloy sheet after the annealing before press-forming.

The structure control of the alloy sheet of the present invention is realized by controlling the frequency of nucleation during recrystallization, through the control of comprehensive structure of the alloy during hot-rolled sheet annealing, and adequate reduction ratio of finish cold-rolling in response to the grain size before finish cold-rolling. FIG. 3 shows that further reduction of 0.2% proof stress after the annealing before press-forming is achieved by optimizing the reduction ratio of finish cold-rolling (R%). In concrete terms, by controlling the value of the reduction ratio of finish cold-rolling to satisfy the equations of (2a) and (2b), that is, the value is in the region of II in FIG. 3, the 0.2% proof stress can be 27.5 kgf/mm$^2$ or less.

$$21 \leqq R \leqq 70 \quad (2a)$$

$$6.38D-122.6 \leqq R \leqq 6.38D-65.2 \quad (2b)$$

Furthermore, by controlling the value of the reduction ratio to satisfy the equations of (3a) and (3b), that is, the value is in the region of III, the 0.2% proof stress can be 27 kgf/mm$^2$ or less.

$$26 \leqq R \leqq 63 \quad (2a)$$

$$6.38D-108.0 \leqq R \leqq 6.38D-79.3 \quad (2b)$$

From the above described reason, the present invention specifies the reduction ratio of finish cold-rolling R(%) which satisfies the equations of (2a) and (2b) above, responding to the average austenite grain size D (μm) before finish cold-rolling to obtain 0.2% proof stress of 27.5 kgf/mm$^2$ or less, and specifies the reduction ratio of finish cold-rolling R(%) which satisfies the equations of (3a) and (3b) above, responding to the average austenite grain size D (μm) before finish cold-rolling to obtain 0.2% proof stress of 27.0 kgf/mm$^2$ or less.

The average austenite grain size specified by the relation with reduction ratio of finish cold-rolling, R, is obtained by annealing a hot-rolled sheet followed by cold-rolling and annealing in a temperature range of 860° to 950° C. for 0.5 to 2 min.

Figure 4:
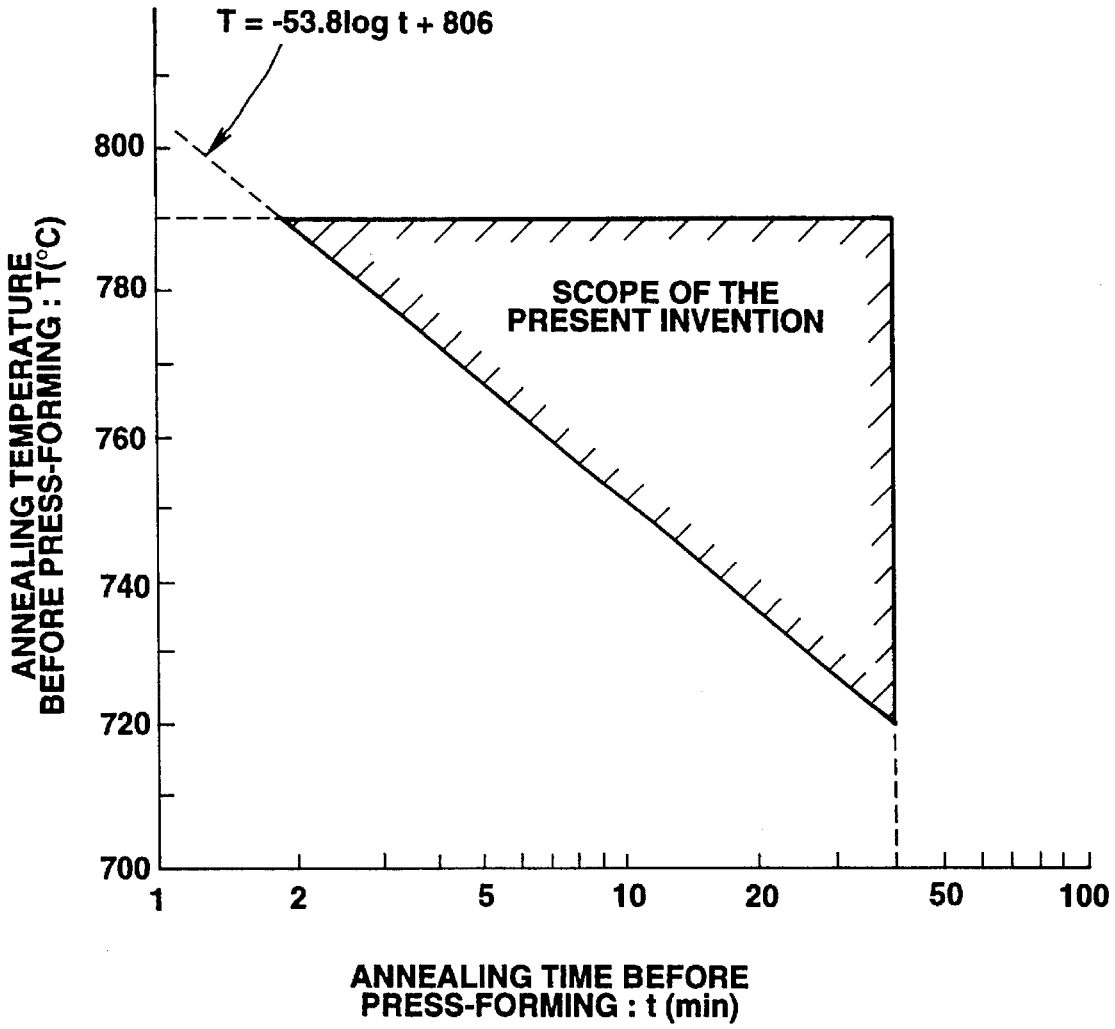
FIG. 4 is a graph showing a relationship among conditions of annealing before press-forming, 0.2% proof stress after the annealing before press-forming and the gathering degree of {211} plane according to the preferred embodiment-1.

FIG. 4 shows the relation among annealing temperature before press-forming (T), annealing time (t), 0.2% proof stress after annealing before press-forming and gathering degree of {211} plane of an alloy sheet. The alloy sheet was manufactured by the process including annealing of hot-rolled sheet in a temperature of 910° to 990° C., cold-rolling, recrystallization annealing, cold-rolling, recrystallization annealing, finishing cold-rolling and annealing before press-forming and by controlling the conditions such as composition, annealing condition of the hot-rolled sheet and reduction ratio of finish cold-rolling responding to the average austenite grain size before finish cold-rolling to satisfy the specification of present invention.

As clearly shown in FIG. 4, even if the annealing condition of the hot-rolled sheet, austenite grain size before finish cold-rolling, and the finish cold-rolling reduction ratio stay within the range specified in this invention, when the temperature of annealing before press-forming has the relation of $T<-53.8 \log t+806$, then the satisfactory recrystallization is not conducted and 0.2% proof stress exceeds 28.0 kgf/mm$^2$ and the gathering degree of {211} plane exceeds 16%, which characteristic values do not satisfy the range specified in this invention. When the temperature (T) of annealing before press-forming, exceeds 790° C. or when annealing time (t) before press-forming exceeds 40 min., then the {211} plane develops to increase the gathering degree of {211} plane higher than 16%, which is inadequate, also. Consequently, to obtain the value of 0.2% proof stress and degree of {211} plane specified in this invention, this invention specifies the temperature (T) of annealing before press-forming, 790° C. or less, and the annealing time (t) before press-forming 40 min. or less and $T \geqq -53.8 \log t+806$.

Figure 5:
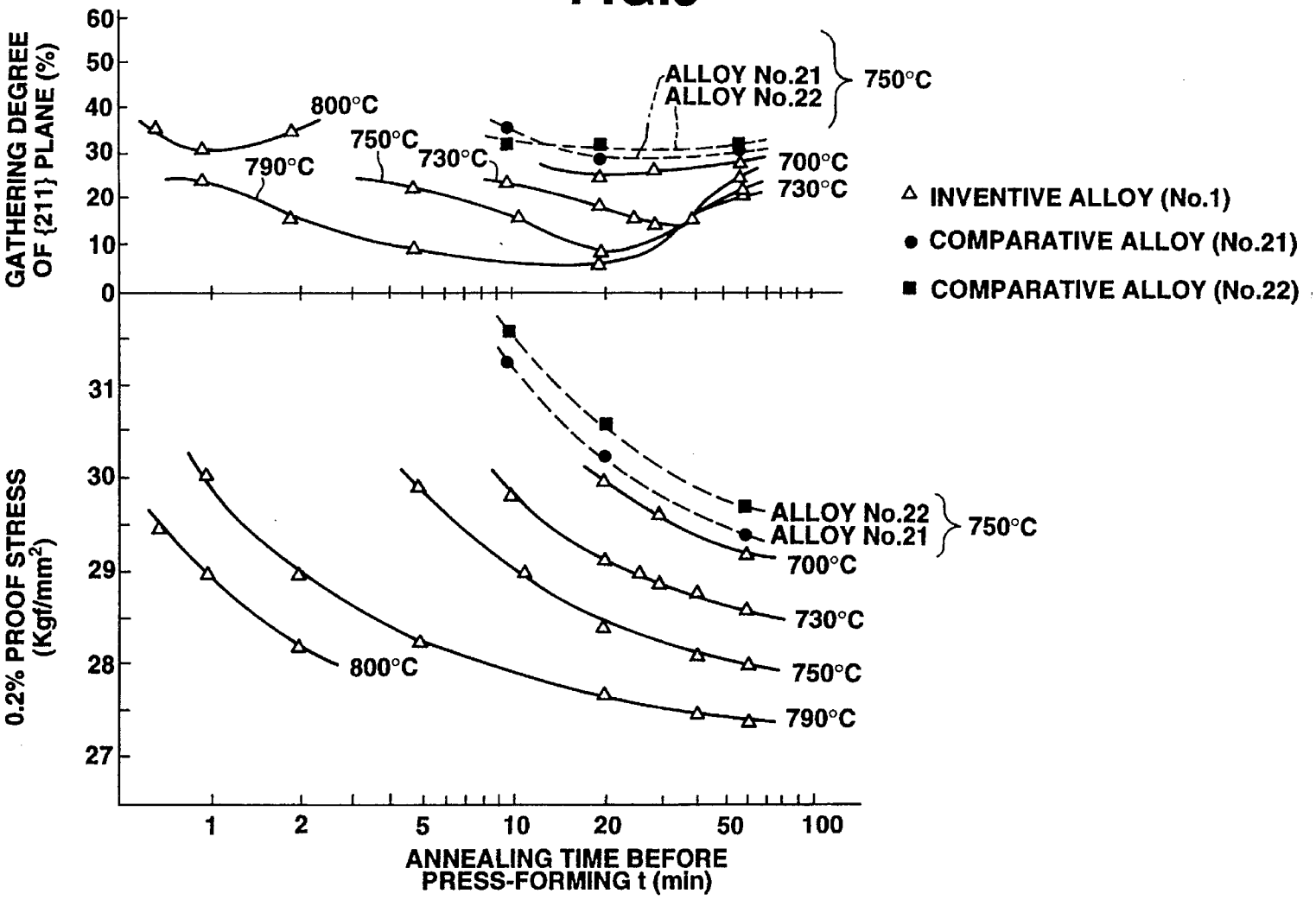
FIG. 5 is a graph showing a relationship among conditions of annealing before press-forming, 0.2% proof stress after the annealing before press-forming and the gathering degree of {211} plane according to the preferred embodiment-1.

FIG. 5 shows a relation between the 0.2% proof stress responding to the time of annealing before press-forming and the change of gathering degree of {211} plane for each annealing temperature. The employed alloys were No. 1 alloy of the present invention and alloys No. 21 and 22, which are comparative alloys. They are hot-rolled to manufacture the hot-rolled sheet, then subjected to the process of annealing in a temperature range of 910° to 990° C., cold-rolling, recrystallization annealing, cold-rolling, recrystallization annealing, finish cold-rolling and annealing before press-forming. In both case, the condition of annealing of hot-rolled sheet, reduction ratio of finish cold-rolling responding to the average austenite grain size before finish cold-rolling remained within the range specified in this invention.

According to FIG. 5, within the condition of annealing before press-forming specified in this invention, the alloy of this invention gives both 0.2% proof stress and gathering degree of {211} plane specified in this invention. The comparative alloys clearly have problems in their press-formability with 0.2% proof stress exceeding 28.0 kgf/mm$^2$ even if annealed at 750° C., and the gathering degree of {211} plane exceeding the limit specified in the present invention. Accordingly, the present invention emphasizes the alloy composition as well as the specification on manufacturing method.

The annealing before press-forming of this invention may be carried before photo-etching. In that case, if the condition of annealing before press-forming is kept within the range specified in this invention, then a satisfactory photo-etching quality is secured. As for the alloy of prior art, annealing before press-forming can not be conducted before photo-etching because the photo-etching after the annealing before press-forming following the conditions of this invention results in poor quality of photo-etching. On the contrary, the alloy of this invention having specified composition and gathering degree of {211} plane keeps favorable quality if photo-etching after annealing before press-forming is conducted.

There are other methods to limit the degree of {211} plane on the alloy sheet after the annealing before press-forming within the range specified in this invention. Examples of these methods are rapid solidification and comprehensive texture control through the control of recrystallization during hot-working.

EXAMPLE 1

A series of ladle refining produced alloy of No 1 through No. 23 having the composition shown in Table 1 and Table 2. Alloys of No. 1 through No. 13 and No. 18 through No. 23 were casted into ingots. Those ingots were subjected to adjusting, blooming, scarfing and hot-rolling (at 1100° C. for 3 hrs) to provide hot-rolled sheet. Alloys of No. 14 through No. 17 were directly casted into thin plates, these plates were hot-rolled at the reduction ratio of 40%, then rolled at 700° C. to provide a hot-rolled sheet. These hot-rolled sheets were subjected to annealing (at 930° C.), cold-rolling, recrystallization annealing, cold-rolling, recrystallization annealing (following the condition shown in Table 5) and finish cold-rolling (at the reduction ratio of 21%) to provide alloy sheets having 0.25 mm thickness. The hot-rolled sheet were fully recrystallized by hot-rolling. The alloy sheets were etched to make flat masks, which flat masks were then treated by the annealing before press-forming at 750° C. for 20 min. to provide material No. 1 through No. 23. These were press-formed to inspect the press-formability. Table 1 and Table 2 shows the average austenite grain size before finish cold-rolling of each material, and Table 3 and Table 4 shows the gathering degree of {211} plane, tensile property and press-formability. The tensile property (0.2% proof stress and elongation perpendicular to the rolling direction) and gathering degree of {211} plane was inspected after annealing before press-forming. The tensile property was determined at room temperature. The measurement of degree of the gathering degree of {211} plane was carried with X-ray diffraction method described before. As shown in Table 3 and Table 4, materials of No. 1 through No. 13, which have the chemical composition, gathering degree of {211} plane, and 0.2% proof stress within the range specified in the present invention, show excellent press-formability. Materials of No. 1 through No. 17 of the present invention that includes Co also show excellent press-formability.

On the contrary, material No. 18 through No. 20 gives Si and Ni content above the upper limit of this invention and raises a problem in times to die. Material No. 19 gives 0 content above the upper limit of this invention and also gives 0.2% proof stress above the upper limit, 28.9 kgf/mm$^2$, which results in a poor shape fix ability and induces crack generation. Material No. 21 and No. 22 are comparative examples giving B content and B and 0 content above the upper limits of this invention, respectively, both gives 0.2% proof stress above the upper limit of this invention, 28.0 kgf/mm$^2$, to degrade the shape fix ability. These comparative materials gives gathering degree of {211} plane above the upper limit of the present invention to induce cracking of alloy sheet. The average austenite grain size before finish cold-rolling of material No. 23 fails to reach the level that satisfies the reduction ratio of finish cold-rolling, which gives 0.2% proof stress of more than 28.0 kgf/mm$^2$ to degrade shape fix ability and induces crack generation.

The above discussion clearly shows that Fe—Ni alloy sheet and Fe—Ni—Co alloy having high press-formability aimed in this invention is prepared by adjusting the chemical composition, degree of {211} plane, and 0.2% proof stress within the range specified in this invention.

TABLE 1

| Material No. | Alloy No. | Chemical composition (wt. %) Ni | Si | O | N | B | C | Mn | Cr | Co | Average austenite grain size before finish cold-rolling (μm) |
|---|---|---|---|---|---|---|---|---|---|---|---|
| 1 | 1 | 35.9 | 0.005 | 0.0010 | 0.0008 | 0.00005 | 0.0013 | 0.25 | 0.01 | — | 18 |
| 2 | 2 | 36.1 | 0.02 | 0.0013 | 0.0010 | 0.0001 | 0.0011 | 0.26 | 0.02 | — | 17 |
| 3 | 3 | 36.0 | 0.03 | 0.0014 | 0.0011 | 0.0001 | 0.0015 | 0.04 | 0.02 | 0.002 | 17 |
| 4 | 4 | 36.5 | 0.04 | 0.0020 | 0.0015 | 0.0002 | 0.0045 | 0.30 | 0.02 | 0.650 | 15 |
| 5 | 5 | 35.8 | 0.01 | 0.0015 | 0.0010 | 0.0002 | 0.0029 | 0.25 | 0.05 | 0.010 | 14 |
| 6 | 6 | 35.7 | 0.01 | 0.0012 | 0.0009 | 0.0001 | 0.0029 | 0.27 | 0.01 | — | 15 |
| 7 | 7 | 36.0 | 0.02 | 0.0008 | 0.0007 | 0.0002 | 0.0009 | 0.11 | 0.03 | 0.055 | 14 |
| 8 | 8 | 36.2 | 0.05 | 0.0005 | 0.0005 | 0.0001 | 0.0007 | 0.05 | 0.02 | — | 12 |
| 9 | 9 | 36.3 | 0.001 | 0.0002 | 0.0002 | 0.0001 | 0.0005 | 0.005 | 0.001 | 0.530 | 13 |
| 10 | 10 | 35.5 | 0.04 | 0.0018 | 0.0011 | 0.0001 | 0.0032 | 0.01 | 0.01 | — | 12 |
| 11 | 11 | 35.8 | 0.03 | 0.0016 | 0.0012 | 0.00001 | 0.0030 | 0.20 | 0.02 | 0.001 | 20 |
| 12 | 12 | 35.9 | 0.05 | 0.0019 | 0.0013 | 0.00002 | 0.0050 | 0.29 | 0.03 | — | 22 |

TABLE 2

| Material No. | Alloy No. | Chemical composition (wt. %) Ni | Si | O | N | B | C | Mn | Cr | Co | Average austenite grain size before finish cold-rolling (μm) |
|---|---|---|---|---|---|---|---|---|---|---|---|
| 13 | 13 | 36.0 | 0.01 | 0.0017 | 0.0012 | 0.00001 | 0.0037 | 0.05 | 0.04 | 0.001 | 24 |
| 14 | 14 | 31.9 | 0.05 | 0.0021 | 0.0015 | 0.0001 | 0.0018 | 0.13 | 0.02 | 5.200 | 23 |
| 15 | 15 | 31.0 | 0.03 | 0.0014 | 0.0019 | 0.0005 | 0.0020 | 0.30 | 0.04 | 5.953 | 12 |
| 16 | 16 | 30.0 | 0.02 | 0.0017 | 0.0016 | 0.0002 | 0.0023 | 0.24 | 0.04 | 4.101 | 15 |
| 17 | 17 | 29.5 | 0.01 | 0.0016 | 0.0008 | 0.0015 | 0.0045 | 0.35 | 0.03 | 6.521 | 13 |
| 18 | 18 | 35.6 | 0.08 | 0.0020 | 0.0014 | 0.0002 | 0.0021 | 0.28 | 0.03 | — | 16 |
| 19 | 19 | 36.2 | 0.05 | 0.0035 | 0.0012 | 0.0001 | 0.0017 | 0.31 | 0.04 | — | 15 |
| 20 | 20 | 36.3 | 0.04 | 0.0018 | 0.0020 | 0.0002 | 0.0019 | 0.25 | 0.03 | — | 17 |
| 21 | 21 | 36.1 | 0.05 | 0.0018 | 0.0015 | 0.0025 | 0.0026 | 0.30 | 0.05 | 0.020 | 15 |
| 22 | 22 | 35.8 | 0.05 | 0.0023 | 0.0016 | 0.0021 | 0.0032 | 0.27 | 0.04 | 0.002 | 14 |
| 23 | 23 | 34.2 | 0.02 | 0.0020 | 0.0007 | 0.0010 | 0.0017 | 0.31 | 0.05 | 2.534 | 10 |

TABLE 3

| Material No. | Alloy No. | Tensile property: 0.2% proof stress (kgf/mm$^2$) | Elongation perpendicular to the rolling direction (%) | Gathering degree of [211] plane (%) | Press formability: Shape fix, ability | Fitnes to die | Cracking on the alloy sheet |
|---|---|---|---|---|---|---|---|
| 1 | 1 | 27.5 | 43.2 | 9 | ◎ | ○ | None |
| 2 | 2 | 27.4 | 42.9 | 10 | ◎ | ○ | None |
| 3 | 3 | 27.4 | 43.1 | 10 | ◎ | ○ | None |
| 4 | 4 | 28.0 | 41.0 | 16 | ○ | ○ | None |
| 5 | 5 | 27.8 | 43.2 | 15 | ○ | ○ | None |
| 6 | 6 | 27.5 | 44.4 | 12 | ◎ | ○ | None |
| 7 | 7 | 27.2 | 42.2 | 16 | ◎ | ○ | None |
| 8 | 8 | 26.8 | 44.3 | 14 | ◎ | ○ | None |
| 9 | 9 | 26.3 | 45.6 | 14 | ◎ | ○ | None |
| 10 | 10 | 27.9 | 42.7 | 14 | ○ | ○ | None |
| 11 | 11 | 27.9 | 41.7 | 10 | ○ | ○ | None |
| 12 | 12 | 28.0 | 43.8 | 7 | ○ | ○ | None |

TABLE 4

| Material No. | Alloy No. | Tensile property: 0.2% proof stress (kgf/mm²) | Tensile property: Elongation perpendicular to the rolling direction (%) | Gathering degree of {211} plane (%) (%) | Press formability: Shape fix, ability | Press formability: Fitnes to die | Press formability: Cracking on the alloy sheet |
|---|---|---|---|---|---|---|---|
| 13 | 13 | 27.9 | 45.1 | 6 | o | o | None |
| 14 | 14 | 27.9 | 43.5 | 8 | o | o | None |
| 15 | 15 | 27.8 | 41.20 | 12 | o | o | None |
| 16 | 16 | 27.6 | 42.10 | 10 | o | o | None |
| 17 | 17 | 27.6 | 42.05 | 11 | o | o | None |
| 18 | 18 | 27.9 | 41.1 | 15 | o | x | None |
| 19 | 19 | 28.4 | 40.1 | 16 | Δ | o | Yes |
| 20 | 20 | 28.0 | 42.3 | 12 | o | x | None |
| 21 | 21 | 29.5 | 39.8 | 30 | x | o | Yes |
| 22 | 22 | 29.9 | 39.0 | 32 | x | o | Yes |
| 23 | 23 | 28.5 | 36.2 | 16 | x | o | Yes |

TABLE 5

| Material No. | Annealing condition |
|---|---|
| 1 | 890° C. × 1 min. |
| 2 | 890° C. × 1 min. |
| 3 | 890° C. × 1 min. |
| 4 | 880° C. × 0.8 min. |
| 5 | 880° C. × 0.8 min. |
| 6 | 880° C. × 0.8 min. |
| 7 | 880° C. × 0.8 min. |
| 8 | 870° C. × 1 min. |
| 9 | 870° C. × 1 min. |
| 10 | 870° C. × 1 min. |
| 11 | 910° C. × 1 min. |
| 12 | 920° C. × 0.5 min. |
| 13 | 930° C. × 0.5 min. |
| 14 | 920° C. × 0.5 min. |
| 15 | 870° C. × 1 min. |
| 16 | 880° C. × 0.8 min. |
| 17 | 870° C. × 1 min. |
| 18 | 890° C. × 1 min. |
| 19 | 890° C. × 1 min. |
| 20 | 890° C. × 1 min. |
| 21 | 890° C. × 1 min. |
| 22 | 890° C. × 1 min. |
| 23 | 850° C. × 1 min. |

EXAMPLE 2

Hot-rolled sheets of alloy No. 1, 9, and 14, which were used in Example 1, were employed. The annealing for hot-rolled sheet was applied to these materials under various annealing conditions given in Table 6, and no annealing was applied to one material, which is also given in the table. They were subjected to cold-rolling, recrystallization annealing, cold rolling, recrystallization annealing (at 890° C. for 1 min.), finish cold-rolling (at 21% of reduction ratio) to provide alloy sheet having 0.25 mm thickness. The flat masks were then treated by the annealing before press-forming at 750° C. for 15 min. to give materials No. 24 through No. 28. The flat masks were press-formed and were tested for press-formability. Table 6 shows the annealing temperature, average austenite grain size before finish cold-rolling and gathering degree of {211} plane. Table 7 shows tensile properties and press-formability. The method for measuring properties was the same as in Example 1.

As shown in Table 6 and 7, materials No. 24 and No. 25 having the chemical composition and satisfying the conditions specified in the present invention have excellent press-formability. On the contrary, materials No. 26 through No. 28 give hot-rolled sheet annealing temperature above the limit of this invention, and all of these materials give the gathering degree of {211} plane above the upper limit of this invention and generate cracks on alloy sheet during press-forming. Furthermore, material No. 28 gives 0.2% proof stress of more than 28.0 kgf/mm² and raises problem of shape fix ability during press-forming.

Consequently, to keep the degree of {211} plane within the range specified in this invention, it is important to carry the hot-rolled sheet annealing following the conditions specified in this invention.

TABLE 6

| Material No. | Alloy No. | Hot-rolled sheet annealing temperature (°C.) | Average austenite grain size before finish cold-rolling (μm) | Gathering degree of {211} plane |
|---|---|---|---|---|
| 24 | 14 | 930 | 18 | 8 |
| 25 | 9 | 960 | 18 | 7 |
| 26 | 1 | 900 | 17 | 31 |
| 27 | 1 | 1000 | 18 | 35 |
| 28 | 1 | —* | 17 | 38 |

*Hot-rolled sheet annealing was not applied

TABLE 7

| Material No. | Tensile property: 0.2% Proof stress (kfg/mm²) | Tensile property: Elongation perpendicular to the rolling direction (%) | Press-formability: Shape fix ability | Press-formability: Fitness to die | Press-formability: Cracking on the alloy sheet |
|---|---|---|---|---|---|
| 24 | 27.7 | 43.3 | ⊙ | o | None |
| 25 | 27.4 | 43.2 | ⊙ | o | None |
| 26 | 27.9 | 38.5 | o | o | Yes |
| 27 | 28.0 | 39.0 | o | o | Yes |
| 28 | 28.2 | 36.2 | Δ | o | Yes |

EXAMPLE 3

Hot-rolled sheets of alloy No. 1, 2, 4, 6, 7, 8, 9, 11, 12, 13 and 14 which were used in Example 1 were employed. These hot-rolled sheet were subjected to the process including annealing (at 930° C.), cold-rolling, recrystallization annealing, cold-rolling, recrystallization annealing (at the temperature shown in Table 8 and Table 9 for 1 min.), finish cold-rolling to obtain the alloy sheet having 0.25 mm thickness. The alloy sheets were etched to make flat masks, which flat masks were then subjected to annealing before press-forming at 750° C. for 20 min. to obtain material No. 29 through No. 66. These materials were press-formed to determine the press-formability. Table 8 and Table 9 shows the annealing temperature before finish cold-rolling, average austenite grain size before finish cold-rolling, reduction ratio of finish cold rolling and tensile property. Table 10 and Table 11 shows the gathering degree of {211} plane and press-formability. The method for measuring properties was the same as in Example 1.

Table 8 through Table 11 shows that material No. 30 through No. 35, No. 38, No. 41 through 43 and No. 47 through 66, which have chemical composition and satisfy the conditions of hot-rolled sheet annealing and annealing before press-forming specified in the present invention and give the relation between average austenite grain size before finish cold-rolling and reduction ratio of finish cold-rolling in a region specified in the present invention, give 16% or less of {211} plane. Of these, material No. 30, No. 35, No. 38, No. 41, No. 47, No. 49, No. 50, No. 54, No. 60, No. 63 and No. 66 employed reduction ratios of finish cold-rolling, R, (in the Region I in FIG. 3) satisfying the above described equations of (1a) and (1b) to give 0.2% proof stress of 28.0 kgf/mm$^2$ or less. Material No. 31, No. 33, No. 34, No. 43, No. 48, No. 52, No. 55, No. 59 and No. 65 employed reduction ratios of finish cold-rolling, R, (in the Region II in FIG. 3) satisfying the above described equations of (2a) and (2b) to give 0.2% proof stress of 27.5 kgf/mm$^2$ or less. Material No. 32, No. 42, No. 51, No. 53, No. 56, No. 57, No. 58, No. 61, No. 62 and No. 64 employed reduction ratios of finish cold-rolling, R, (in the Region III in FIG. 3) satisfying the above described equations of (3a) and (3b) to give 0.2% proof stress of 27.0 kgf/mm$^2$ or less. All of these materials give 0.2% proof stress being aimed in this invention and show high pressforming quality. Accordingly, the decrease of 0.2% proof stress proved to improve the shape fix ability.

Contrary to the above preferable embodiment, the relation among the average austenite grain size before finish cold-rolling, conditions of hot-rolled sheet annealing and reduction ratio of finish cold-rolling of comparative materials of No. 29, No. 36, No. 37, No. 39, No. 40, No. 44, and No. 45 fails to satisfy the condition specified in the present invention even if they satisfy the condition of chemical composition, hot-rolled sheet annealing and annealing before press-forming specified in the present invention. They are out of scope of this invention for one of the 0.2% proof stress and the gathering degree of {211} plane or both, and they raise problem of at least one of the shape fix ability and crack generation on alloy sheet during press-forming or both.

Material No. 46 was treated by the annealing before finish cold-rolling at 850° C. for 1 min. Such an annealing condition gives 10.0 μm of austenite grain size, so the 0.2% proof stress exceeds 28.0 kgf/mm$^2$ even if the reduction ratio of finish cold-rolling is selected to 15%. These figures can not provide a shape fix ability during press-forming to satisfy the specifications of this invention.

As discussed in detail thereabove, though the condition that the chemical composition, condition of hot-rolled sheet annealing, and condition of the annealing before press-forming are kept in the range specified in this invention, it is important to keep the austenite grain size before finish cold-rolling and the reduction ratio of finish cold-rolling within the range specified in this invention to obtain satisfactory press-formability being aimed by this invention.

TABLE 8

| | | Annealing | | | Tensile property | |
|---|---|---|---|---|---|---|
| Material No. | Alloy No. | temperature before finish cold-rolling (°C.) | Average austenite grain size before finish cold-rolling (μm) | Reduction ratio of finish cold-rolling (%) | 0.2% proof stress (kgf/mm$^2$) | Elongation perpendicular to the rolling direction (%) |
| 29 | 1 | 890 | 18.0 | 10 | 29.7 | 37.4 |
| 30 | 1 | 890 | 18.0 | 16 | 28.0 | 41.1 |
| 31 | 1 | 890 | 18.0 | 21 | 27.5 | 43.1 |
| 32 | 1 | 890 | 18.0 | 30 | 26.8 | 41.2 |
| 33 | 1 | 890 | 18.0 | 50 | 27.2 | 42.4 |
| 34 | 1 | 890 | 18.0 | 50 | 27.5 | 41.7 |
| 35 | 1 | 890 | 18.0 | 60 | 27.9 | 43.7 |
| 36 | 1 | 890 | 18.0 | 70 | 28.5 | 37.5 |
| 37 | 2 | 860 | 11.0 | 21 | 28.1 | 36.5 |
| 38 | 1 | 920 | 23.3 | 21 | 27.8 | 41.6 |
| 39 | 1 | 930 | 26.5 | 21 | 28.5 | 36.0 |
| 40 | 2 | 860 | 11.0 | 50 | 28.8 | 40.1 |
| 41 | 1 | 880 | 16.4 | 50 | 27.9 | 43.0 |
| 42 | 1 | 920 | 23.3 | 50 | 26.3 | 42.6 |
| 43 | 1 | 930 | 26.5 | 50 | 27.3 | 44.1 |
| 44 | 1 | 940 | 32.5 | 50 | 29.0 | 38.6 |
| 45 | 1 | 920 | 23.3 | 78 | 28.6 | 38.1 |
| 46 | 8 | 850 | 10.0 | 15 | 29.6 | 37.6 |
| 47 | 2 | 860 | 11.0 | 16 | 28.0 | 41.0 |

TABLE 9

| Material No. | Alloy No. | Annealing temperature before finish cold-rolling (°C.) | Average austenite grain size before finish cold-rolling (μm) | Reduction ratio of finish cold-rolling (%) | Tensile property: 0.2% proof stress (kgf/mm²) | Tensile property: Elongation perpendicular to the rolling direction (%) |
|---|---|---|---|---|---|---|
| 48 | 6 | 870 | 14.0 | 22.5 | 27.5 | 42.1 |
| 49 | 6 | 870 | 14.0 | 30 | 27.8 | 42.3 |
| 50 | 6 | 870 | 14.0 | 37.5 | 28.0 | 44.1 |
| 51 | 1 | 880 | 16.5 | 26 | 27.0 | 44.3 |
| 52 | 1 | 880 | 16.5 | 40 | 27.5 | 45.2 |
| 53 | 1 | 890 | 18.0 | 35 | 26.9 | 42.6 |
| 54 | 12 | 910 | 20.0 | 74.5 | 28.0 | 41.2 |
| 55 | 14 | 910 | 21.0 | 21 | 27.4 | 42.8 |
| 56 | 11 | 910 | 21.0 | 26 | 27.0 | 43.4 |
| 57 | 11 | 910 | 21.0 | 30 | 26.7 | 42.5 |
| 58 | 11 | 910 | 21.0 | 53 | 26.9 | 41.4 |
| 59 | 11 | 910 | 21.0 | 68.5 | 27.5 | 42.0 |
| 60 | 9 | 865 | 13.0 | 17 | 27.9 | 43.1 |
| 61 | 9 | 920 | 23.3 | 40 | 27.0 | 42.0 |
| 62 | 9 | 920 | 23.3 | 62.5 | 26.9 | 42.5 |
| 63 | 13 | 930 | 26.5 | 40 | 27.8 | 42.4 |
| 64 | 13 | 930 | 26.5 | 60 | 27.0 | 42.6 |
| 65 | 7 | 935 | 29.8 | 69.5 | 27.4 | 42.5 |
| 66 | 4 | 940 | 32.5 | 74.5 | 28.0 | 41.0 |

TABLE 10

| Material No. | Alloy No. | Gathering: degree of {211} plane (%) | Press formability: Shape fix ability | Press formability: Fitness to die | Press formability: Cracking on the alloy sheet |
|---|---|---|---|---|---|
| 29 | 1 | 15 | x | o | Yes |
| 30 | 1 | 15 | o | o | None |
| 31 | 1 | 8 | ⊙ | o | None |
| 32 | 1 | 14 | ⊙ | o | None |
| 33 | 1 | 16 | ⊙ | o | None |
| 34 | 1 | 12 | ⊙ | o | None |
| 35 | 1 | 5 | o | o | None |
| 36 | 1 | 12 | x | o | Yes |
| 37 | 2 | 14 | Δ | o | Yes |
| 38 | 1 | 15 | o | o | None |
| 39 | 1 | 7 | x | o | Yes |
| 40 | 2 | 20 | x | o | Yes |
| 41 | 1 | 8 | o | o | None |
| 42 | 1 | 15 | ⊙ | o | None |
| 43 | 1 | 5 | ⊙ | o | None |
| 44 | 1 | 8 | x | o | Yes |
| 45 | 1 | 26 | x | o | Yes |
| 46 | 8 | 20 | x | o | Yes |
| 47 | 2 | 13 | o | o | None |

TABLE 11

| Material No. | Alloy No. | Gathering: degree of {211} plane (%) | Press formability: Shape fix ability | Press formability: Fitness to die | Press formability: Cracking on the alloy sheet |
|---|---|---|---|---|---|
| 48 | 6 | 13 | ⊙ | o | None |
| 49 | 6 | 11 | o | o | None |
| 50 | 6 | 5 | o | o | None |
| 51 | 1 | 3 | ⊙ | o | None |
| 52 | 1 | 2 | ⊙ | o | None |
| 53 | 1 | 15 | ⊙ | o | None |
| 54 | 12 | 19 | o | o | None |
| 55 | 14 | 8 | ⊙ | o | None |
| 56 | 9 | 9 | ⊙ | o | None |
| 57 | 11 | 11 | ⊙ | o | None |
| 58 | 11 | 13 | ⊙ | o | None |

TABLE 11-continued

| Material No. | Alloy No. | Gathering: degree of {211} plane (%) | Press formability: Shape fix ability | Press formability: Fitness to die | Press formability: Cracking on the alloy sheet |
|---|---|---|---|---|---|
| 59 | 11 | 16 | ⊙ | o | None |
| 60 | 9 | 6 | o | o | None |
| 61 | 9 | 13 | ⊙ | o | None |
| 62 | 9 | 15 | ⊙ | o | None |
| 63 | 13 | 13 | o | o | None |
| 64 | 13 | 16 | ⊙ | o | None |
| 65 | 7 | 15 | ⊙ | o | None |
| 66 | 4 | 15 | o | o | None |

EXAMPLE 4

Hot-rolled sheets of alloy No. 1, 4, 9, 10, 12, 14, 21 and 22 which were used in Example 1 were employed. These hot-rolled sheet were subjected to the process including annealing (at 930° C.), cold-rolling, recrystallization annealing, cold-rolling, recrystallization annealing (at 890° C. for 1 min.), finish cold-rolling (at 21% of reduction ratio) to obtain the alloy sheet having 0.25 mm thickness. The alloy sheets were etched to make flat masks, which flat masks were then subjected to annealing before press-forming under the conditions shown in Table 12 to obtain material No. 67 through No. 84. These materials were press-formed to determine the press-formability. Table 12 shows average austenite grain size before finish cold-rolling, condition of annealing before press-forming, gathering degree of {211} plane, tensile property and press-formability. Table 10 and Table 11 shows the gathering degree of {211} plane and press-formability. The method for measuring properties was the same as in Example 1.

Table 12 shows that material No. 67, No. 69, No. 70 and No. 76 through No. 84, which satisfy the conditions of chemical composition and hot-rolled sheet annealing, finish cold-rolling (reduction ratio of finish cold rolling), annealing before press-forming (temperature, time) specified in the present invention give the gathering degree of {211} plane of 16% or less. All of these materials give 0.2% proof stress being aimed in this invention and show high press-forming quality.

Contrary to the above preferable embodiment, comparative materials of No. 72 and No. 73 were annealed before press-forming at the temperature and for a time above the upper limit of the present invention though they satisfy the condition of chemical composition, hot-rolled sheet annealing and finish cold-rolling (reduction ratio of finish cold-rolling) specified in the present invention. They give the gathering degree of {211} plane of 16% or more and cracking is generated. Comparative material No. 63 was annealed before press-forming at a temperature of (T) and for a time of (t), which do not satisfy the equation of ($T \geqq -53.8 \log t + 806$). Comparative material No. 71 was annealed before press-forming for a time above the upper limit of the present invention and annealing temperature T and annealing time t do not satisfy the above described equation. All of these comparative materials give 0.2% proof stress of more than 28.0 kgf/mm$^2$, and they have problem in shape fix ability during press-forming. The degree of {211} plane of these materials exceed 16%, and cracks are generated on alloy sheet.

Materials of No. 74 and No. 75 employed comparative alloys. Even the annealing before press-forming is carried at 750° C. for 60 min., their 0.2% proof stress values exceed 28.0 kgf/mm$^2$ and they have problem in shape fix ability during press-forming. The gathering degree of {211} plane of these materials exceed 16%, and cracks are generated on alloy sheet.

As described in detail thereabove, though the condition that the chemical composition, condition of hot-rolled sheet annealing and reduction ratio of finish cold-rolling are kept in the range specified in this invention, it is important to keep the condition of annealing before press-forming within the range specified in this invention to obtain satisfactory press-form quality being aimed by this invention.

EXAMPLE 5

Hot-rolled sheets of alloy No. 1 and No. 4, which were used in Example 1, were employed. These sheets were subjected to annealing (at 930° C.), cold-rolling, recrystallization annealing, cold rolling, recrystallization annealing (at 890° C. for 1 min.), and finishing cold-rolling (at 21% of reduction ratio) to obtain alloy sheets having 0.25 mm thickness. These ahoy sheets were annealed before press-forming under the conditions shown in Table 13 to obtain Material No. 85 through No. 87. The alloy sheets were etched to make flat masks. The press-forming was applied to these flat masks then the press-form quality was determined. Table 13 shows the average austenite grain size, condition of annealing before press-forming and gathering degree of {211} plane of each material. Table 14 shows the tensile property, press-formability and etching performance. Etching performance was determined by visual observation of irregularity appeared on the etched flat masks. The measuring method for each property was the same as in Example 1.

Table 13 and Table 14 indicate that materials of No. 85 through No. 87 which satisfy the condition of chemical composition and manufacturing process specified in the present invention give favorable state without irregularity in etching, the gathering degree of {211} plane of 16% or less, and 0.2% proof stress within the range specified in this invention. All of these materials show excellent press-form quality.

Therefore, it is important to keep the chemical composition and manufacturing process specified in this invention to obtain satisfactory press-form quality being aimed by this invention. If these conditions are satisfied, an alloy sheet subjected to etching after the annealing before press-forming gives a flat mask having the desired etching performance free of irregularity.

As described in detail in Example 1 through Example 5, the alloy sheets having the gathering degree of {211} plane of higher than 16% give lower elongation perpendicular to rolling direction after the annealing before press-forming

TABLE 12

| Material No. | Alloy No. | Average austenite grain size before finish cold-rolling (μm) | Condition of annealing before press forming: Temperature (°C.) | Condition of annealing before press forming: Time (min) | Gathering degree of {211} plane (%) | Tensile property: 0.2% proof stress (kgf/mm$^2$) | Tensile property: Elongation perpendicular to the rolling direction (%) | Press formability: Shape fix ability | Press formability: Fitnes to die | Cracking on the alloy sheet |
|---|---|---|---|---|---|---|---|---|---|---|
| 67 | 1 | 18 | 730 | 30 | 13 | 27.9 | 41.5 | ○ | ○ | None |
| 68 | 1 | 18 | 750 | 5 | 23 | 28.9 | 40.0 | x | ○ | Yes |
| 69 | 1 | 18 | 750 | 20 | 8 | 27.4 | 43.1 | ◎ | ○ | None |
| 70 | 1 | 17 | 790 | 2 | 15 | 28.0 | 42.0 | ○ | ○ | None |
| 71 | 1 | 18 | 700 | 60 | 28 | 28.2 | 38.4 | Δ | ○ | Yes |
| 72 | 1 | 18 | 800 | 2 | 36 | 27.2 | 35.7 | ◎ | ○ | Yes |
| 73 | 1 | 17 | 750 | 60 | 20 | 27.0 | 38.1 | ◎ | ○ | Yes |
| 74 | 21 | 15 | 750 | 60 | 31 | 28.4 | 38.2 | Δ | Δ | Yes |
| 75 | 22 | 14 | 750 | 60 | 32 | 28.7 | 38.9 | x | ○ | Yes |
| 76 | 10 | 16.5 | 790 | 10 | 8 | 27.4 | 44.3 | ◎ | ○ | None |
| 77 | 1 | 18 | 790 | 40 | 16 | 26.5 | 41.0 | ◎ | ○ | None |
| 78 | 12 | 17 | 770 | 5 | 13 | 27.8 | 41.3 | ○ | ○ | None |
| 79 | 12 | 17 | 770 | 15 | 8 | 27.0 | 44.0 | ◎ | ○ | None |
| 80 | 14 | 17 | 770 | 40 | 16 | 26.8 | 43.0 | ◎ | ○ | None |
| 81 | 1 | 18 | 750 | 11 | 16 | 28.0 | 41.1 | ○ | ○ | None |
| 82 | 1 | 18 | 750 | 40 | 16 | 27.1 | 41.0 | ◎ | ○ | None |
| 83 | 9 | 19 | 740 | 18 | 11 | 27.6 | 43.4 | ○ | ○ | None |
| 84 | 4 | 15 | 720 | 40 | 15 | 28.0 | 41.2 | ○ | ○ | None |

than that of the preferred embodiment of this invention. Increased degree of {211} plane presumably decreases the elongation and induces cracks on alloy sheet during press-forming.

TABLE 13

| Material No. | Alloy No. | Average austenite grain size before finish cold-rolling (μm) | Annealing condition before press-forming: Temperature (°C.) | Annealing condition before press-forming: Time (min.) | Gathering degree of {211} plane |
|---|---|---|---|---|---|
| 85 | 1 | 18 | 750 | 20 | 7 |
| 86 | 1 | 17 | 790 | 2 | 15 |
| 87 | 4 | 13 | 720 | 40 | 16 |

TABLE 14

| Material No. | Tensile property: 0.2% proof strength (kgf/mm$^2$) | Tensile property: Elongation perpendicular to the rolling direction (%) | Press-formability: Shape fix ability | Press-formability: Fitness to die | Press-formability: Cracking on the alloy sheet | Etching performance |
|---|---|---|---|---|---|---|
| 85 | 27.4 | 43.0 | ◎ | o | None | No irregularity |
| 86 | 28.0 | 42.0 | o | o | None | No irregularity |
| 87 | 28.0 | 41.2 | o | o | None | No irregularity |

Preferred Embodiment-2

The present invention requests a specific range of yield strength in order to improve the shape fix ability during warm press-forming and to suppress the crack generation on alloy sheet. The yield strength is represented by 0.2% proof stress of 27.5 kgf/mm$^2$ or less at the ambient temperature after softening annealing before press-forming (hereinafter referred to as "annealing before press-forming"). 0.2% proof stress of 27.5 kgf/mm$^2$ or less further improves the shape fix ability.

The gist of the present invention is as follows. (a), Growth of the crystal grain is enhanced during the annealing before press-forming by specifying the content of B and O. Coarsening of crystal grain realizes a low yield strength. (b), Fitness to dies during press-forming is improved by specifying the content of Si and N to suppress galling of dies. (c), Generation of crack during press-forming is suppressed by controlling degree of {211} plane on the thin alloy sheet after the annealing before press-forming.

The invention is described to a greater detail in the following with the reasons to limit the range of the chemical composition of the alloy.

To prevent color-phase shift, the Fe—Ni alloy sheet for shadow mask is necessary to have the upper limit of average thermal expansion coefficient at approximately $3.0\times10^6$ /°C. in the temperature range of 30 to 100°C. The average thermal expansion coefficient depends on the content of Ni in the alloy sheet. The Ni content which satisfies the above limitation of average thermal expansion coefficient is in a range of 34 to 38 wt. %. Consequently, the preferred Ni content is in a range of 34 to 38 wt. %. More preferably, the Ni content to further decrease average thermal expansion coefficient is in the range of 35 to 37 wt. %, and most preferably in the range of 35.5 to 36.5 wt. %.

Usually Fe—Ni alloy includes Co as inevitable impurities. Co of 1 wt. % or less does not affect the characteristics. Ni content which satisfies the above described range is also employed. Fe—Ne—Cr alloy sheet of the present invention may include 1 wt. % or less Co. On the contrary, when Co of over 1 wt. % to 7 wt. % is included, the Ni content which satisfies the above limitation of average thermal expansion coefficient is in a range of 28 to 38 wt. %. Consequently, the Ni content is specified as 28 to 38 wt. % when Co of over 1 wt. % to 7 wt. % is included in Fe—Ni—Co—Cr alloy sheet. Co and Ni content to further improve the characteristics is in a range of 3 to 6 and 30 to 33 wt. %, respectively. As over 7 wt. % Co increases the thermal expansion coefficient, the upper limit of Co content is defined as 7 wt. %.

Chromium is an element that enhances corrosion resistance, but degrades thermal expansion characteristics. Cr content is required to be in a range that improves corrosion resistance and gives thermal expansion characteristics within a permitted limit. Accordingly Cr content is defined to be 0.05 to 3.0 wt. %. Cr of 0.05 wt. % or less can not improve the corrosion resistance, on the other hand, over 3.0 wt. % can not give thermal expansion characteristics specified in the present invention.

Oxygen is one of the inevitable impurities. Increased content of O increases the non-metallic oxide inclusion within the alloy, which inclusion suppresses the growth of crystal grains during the annealing before press-forming, particularly when annealed below 800° C. and for less than 60 min, which is the condition before press-forming specified in this invention. If the content of O exceeds 0.0030%, then the inclusion caused by O considerably suppresses the growth of crystal grains, and 0.2% proof stress after the annealing before press-forming exceeds 27.5 kgf/mm$^2$. At the same time, the corrosion resistance deteriorates. The lower limit of O content is not specially limited, but it is selected to 0.003% from the economy of ingot-making process. The lower limit of O content is not specifically limited, but it is selected to 0.001% from the economy of ingot making process.

Boron enhances the hot-workability of the alloy. Excess amount of B induces the segregation of B at boundary of recrystallized grain formed during the annealing before pressforming, which inhibits the free migration of grain boundaries and results in the suppression of grain growth and the dissatisfaction of 0.2% proof stress after the annealing before press-forming. In particular, under the annealing condition before press-forming which is specified in this invention, the suppression action against the grain growth is strong and the action does not uniformly affect on all grains, so a severe mixed grain structure appears accompanied with irregular elongation of material during press-forming. Boron also increases the gathering degree of {211} plane after annealing, which causes the crack on the skirt of material. Boron content above 0.0030 wt. % significantly enhances the suppression of grain growth, and the 0.2% proof stress exceeds 27.5 kgf/mm$^2$. Also the irregular elongation during press-forming appears, and the degree of {211} plane exceeds the upper limit specified in this invention. Based on these findings, the upper limit of B content is defined as 0.0030 wt. %.

Silicon is used as the deoxidizer during ingot-making of the alloy. Si of above 0.10 wt. % deteriorates the corrosion resistance and forms an oxide film of Si on the surface of alloy during the annealing before press-forming. The oxide film degrades the fitness between die and alloy sheet during press-forming and results in the galling of die by alloy sheet. Consequently, the upper limit of Si content is specified as 0.10 wt. %. Less Si content improves the fitness of die and alloy sheet. The lower limit of Si content is not necessarily specified but practical value is 0.001 wt. % or more from the economy of ingot-making process.

Nitrogen is an element unavoidably entering into the alloy during ingot-making process. Nitrogen content of more than 0.0020 wt. % induces the concentration of N on the surface of alloy during the annealing before press-forming. The concentrated N on the surface of alloy degrades the fitness of die and makes the alloy sheet to gall die. Consequently, the upper limit of N content is specified as 0.0020 wt. %. Although the lower limit of N content is not necessarily defined, the practical value is 0.0001 wt. % or more from the economy of ingot-making process.

Most preferably, the composition further contains 0.0001 to 0.010 wt. % C, 0.001 to 0.50 wt. % Mn.

As described above, the control of chemical composition of alloy and of 0.2% proof stress after the annealing before press-forming specified in this invention suppresses the galling of alloy to dies during press-forming and gives a superior shape fix ability. However, regarding to press-forming quality, there remains the problem of crack generation on press-formed material. To cope with the problem, the inventors studied the relation between the crack generation on the material during press-forming and the crystal orientation during press-forming by changing the crystal orientation of the alloy sheet in various directions using the alloy sheets having chemical composition and 0.2% proof stress in the range specified in this invention, and found that an effective condition to suppress the crack generation on the alloy material is to control the gathering degree of {211} plane to maintain at or below a specified value, as well as to control the 0.2% proof stress after the annealing before press-forming to keep at or below a specified level.

Figure 6:
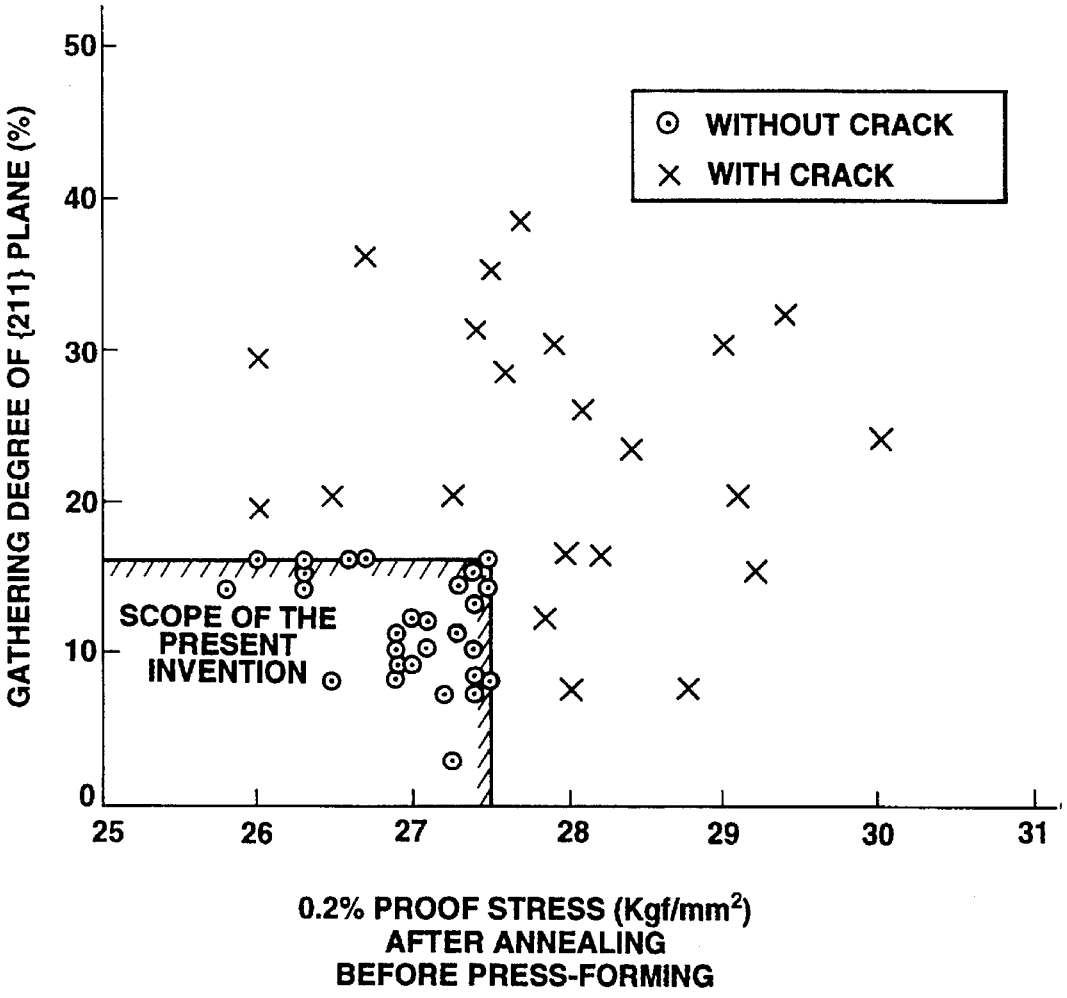
FIG. 6 is a graph showing a relationship among 0.2% proof stress after the annealing before press-forming, the gathering degree of {211} plane and crack generation during press-forming according to the preferred embodiment-2.

FIG. 6 shows the relation among crack generation on alloy sheet during press-forming, gathering degree of {211} plane, and 0.2% proof stress for an alloy sheet having chemical composition specified in the present invention. The gathering degree of {211} plane is determined from the relative X-ray intensity ratio of (422) diffraction plane of alloy sheet after the annealing before press-forming divided by the sum of relative X-ray diffraction intensity ratio of (111), (200), (220), (311), (331), and (420) diffraction planes, where (422) diffraction plane has the equivalent factor with {211} plane.

FIG. 6 clearly shows that the case where 0.2% proof stress does not exceed 27.5 kgf/mm$^2$ and where the gathering degree of {211} plane does not exceed 16% does not induce crack generation on alloy sheet during press-forming, which fact indicates the effect of this invention. Based on the finding, the invention specifies 16% or less of the gathering degree of {211} plane as the condition to suppress crack generation on the alloy sheet.

The alloy sheet of the present invention is manufactured by the following processes. The hot-rolled sheet having the above described chemical composition is annealed, subjected to the process including cold-rolling, final recrystallization annealing and finish cold-rolling, followed by stress relief annealing and annealing before press-forming.

Figure 7:
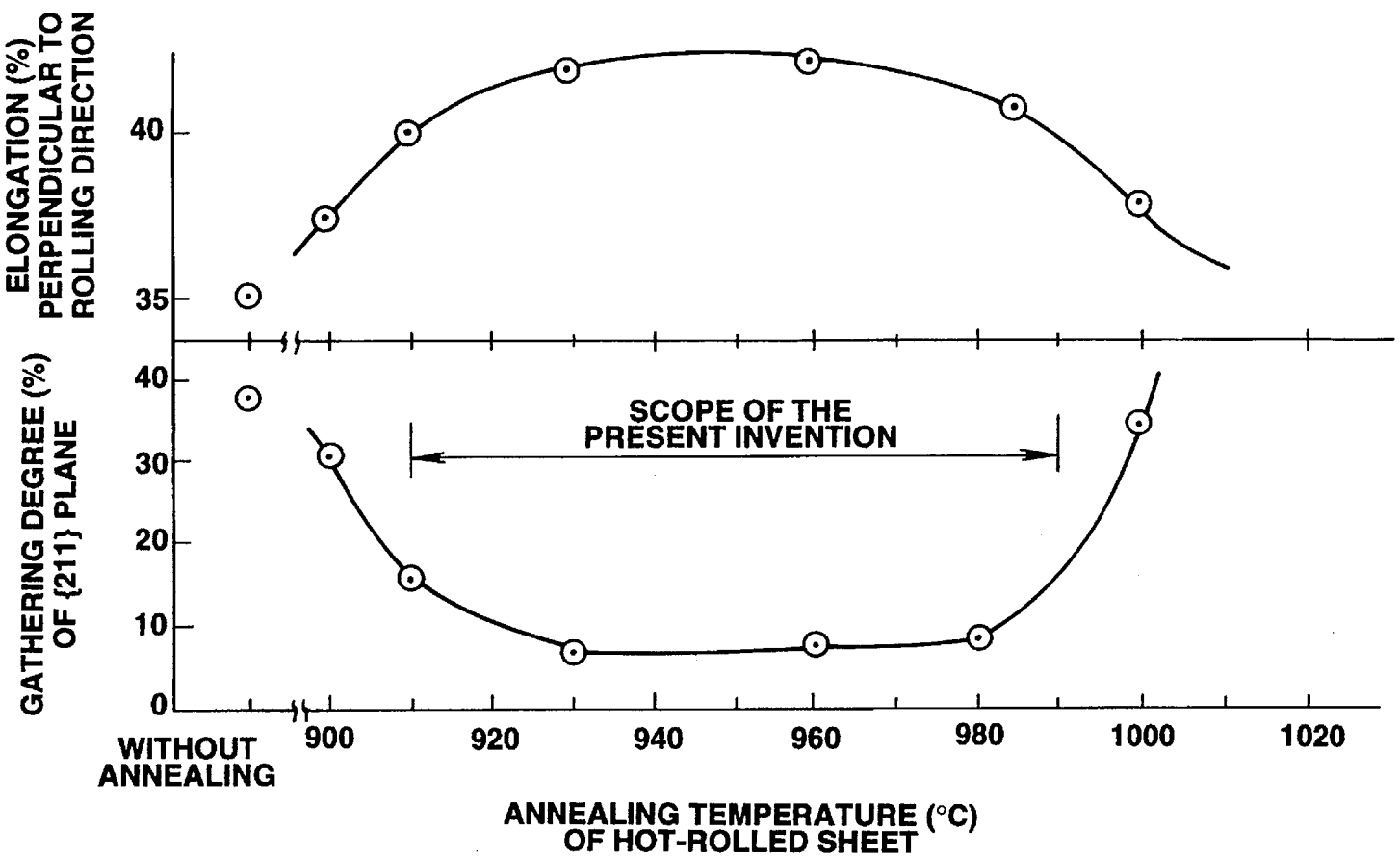
FIG. 7 is a graph showing a relationship between the gathering degree of {211} plane after the annealing before press-forming, the elongation perpendicular to rolling direction and the annealing temperature of hot-rolled sheet according to the preferred embodiment-2.

The processes will be described in detail. The hot-rolled sheet is needed to be annealed in the specified temperature range to maintain the degree of {211} plane of 16% or less. The hot-rolled sheet which satisfies the condition of chemical component specified in the present invention is annealed at different temperatures, subjected to the process including cold-rolling, recrystallization annealing (at 890° C. for 1 min.), finish cold-rolling (at 21% of reduction ratio), stress relief annealing and annealing before press-forming (at 750° C. for 20 min) to obtain the desired alloy sheet. As a comparative example, a hot-rolled strip not annealed was treated under the same condition as thereabove. FIG. 7 shows the relation among gathering degree of {211} plane, elongation perpendicular to rolling direction, and annealing temperature of the alloy sheet treated by the processes above. According to FIG. 7, the gathering degree of {211} plane gave 16% or less in the annealing temperature of 910° to 990° C. of the hot-rolled sheet. Consequently, this invention specifies the temperature of annealing of hot-rolled sheet in the temperature of 910 to 990° C. to assure the degree of {211} plane of 16% or less.

To acquire the satisfactory degree of {211} plane being focused on in this invention, the uniform heat treatment of the slab after slabbing is not preferable. For example, when a uniform heat treatment is carried at 1200° C. or more temperature for 10 hours or more, the degree of {211} plane exceeds the range specified in this invention. Therefore, such a heat treatment must be avoided. The mechanism of crack generation during press-forming under the condition of above 16% of the gathering degree of {211} plane is not clear. FIG. 7 shows the trend that a high degree of {211} plane gives a low elongation perpendicular to the rolling direction. Increased degree of {211} plane decreases the elongation perpendicular to the rolling direction and lowers the fracture limit, then presumably induces cracks.

To keep the gathering degree of {211} plane of 16% or less and to maintain the 0.2% proof stress after the annealing before press-forming of 27.5 kgf/mm$^2$ or less, the control of the condition of finish cold rolling (reduction ratio of finish cold-rolling), and of condition of the annealing before press-forming is important, also.

Figure 8:
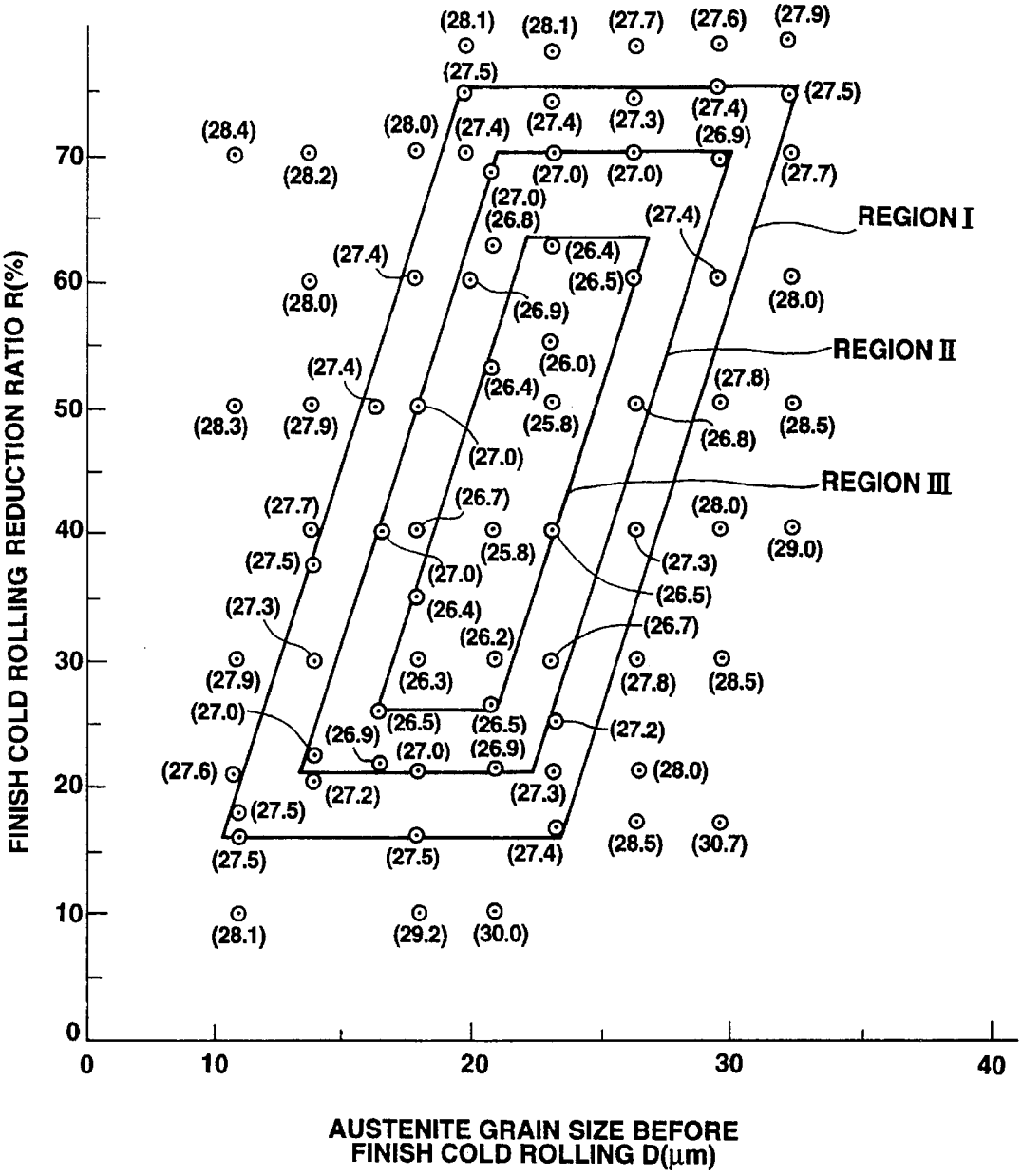
FIG. 8 is a graph showing a relationship among average austenite grain size before finishing cold-rolling, finish cold-rolling reduction ratio and 0.2% proof stress after the annealing before press-forming according to the preferred embodiment-2.

The hot-rolled alloy strip having the composition thereabove was subjected to annealing (in the temperature range of 910° to 990° ° C.), cold-rolling, recrystallization annealing, finish cold-rolling, stress relief annealing and annealing before press-forming (at 750° C. for 20 min.) to produce the alloy sheet. The alloy sheet was tested for tensile strength to determine 0.2% proof stress (the value is shown in the parenthesis in FIG. 3). FIG. 8 shows the relation among the 0.2% proof stress, reduction ratio of finish cold-rolling and average austenite grain size before finish cold-rolling. In this test, the specified austenite grain size was obtained by varying the temperature of recrystallization annealing before finish cold-rolling.

The 0.2% proof of 27.5 kgf/mm$^2$ or less is obtained as shown in FIG. 8 at the reduction ratio of finish cold-rolling R (R%): [16–75%, 6.38D–133.9≦R≦6.38D–51.0], where D=austenite grain size (μm) before finish cold-rolling.

In the case of R<16% or R<[6.38D–133.9], the condition specified in this invention for the annealing before press-forming gives insufficient recrystallization, insufficient growth of recrystallized grain, and 0.2% proof stress of more than 27.5 kgf/mm$^2$, and results in a dissatisfactory alloy sheet. If R>75% or R>6.38D–51.0, then the condition specified in this invention for the annealing before press-forming allows 100% recrystallization but gives excess frequency of nucleation during recrystallization, which decreases the size of recrystallized grain. In that case, the 0.2% proof stress exceeds 27.5 kgf/mm$^2$, and the alloy sheet has unsatisfactory quality.

From the above described reasons, the condition to achieve 0.2% proof stress of 27.5 kgf/mm$^2$ or less by the annealing before press-forming specified in this invention is determined as R (%), the reduction ratio of finish cold-rolling, which satisfies the equations of (1a) and (1b) being described below according to the average austenite grain size before finish cold-rolling.

$$16 \leqq R \leqq 75 \quad (1a)$$

$$6.38D-133.9 \leqq R \leqq 6.38D-51.0 \quad (1b)$$

An adequate value of the reduction ratio of finish cold-rolling (R%) specified above in response to the austenite grain size (D μm) before finish cold-rolling realizes the gathering degree of {211} plane on the surface of alloy sheet after the annealing before press-forming at or below 16%.

The structure control of the alloy sheet of the present invention is realized by controlling the frequency of nucleation during recrystallization, through the texture control of the alloy during hot-rolled sheet annealing and of adequate reduction ratio of finish cold-rolling in response to the grain size before finish cold rolling. FIG. 8 shows that further reduction of 0.2% proof stress after the annealing before press-forming is achieved by optimizing the reduction ratio of finish cold-rolling (R%). In concrete terms, by controlling the value of the reduction ratio of finish cold-rolling to satisfy the equations of (2a) and (2b), that is, the value is in the region of II in FIG. 3, the 0.2% proof stress can be 27.5 kgf/mm$^2$ or less.

$$21 \leqq R \leqq 70 \quad (2a)$$

$$6.38D-122.6 \leqq R \leqq 6.38D-65.2 \quad (2b)$$

Furthermore, by controlling the value of the reduction ratio to satisfy the equations of (3a) and (3b), that is, the value is in the region of III, the 0.2% proof stress can be 26.5 kgf/mm$^2$ or less.

$$26 \leqq R \leqq 63 \quad (3a)$$

$$6.38D-108.0 \leqq R \leqq 6.38D-79.3 \quad (3b)$$

From the above described reason, the present invention specifies the reduction ratio of finish cold-rolling R(%) which satisfies the equations of (2a) and (2b) above, responding to the average austenite grain size D (μm) before finish cold-rolling to obtain 0.2% proof stress of 27.0 kgf/mm$^2$ or less, and specifies the reduction ratio of finish cold-rolling R(%) which satisfies the equations of (3a) and (3b) above, responding to the average austenite grain size D (μm) before finish cold-rolling to obtain 0.2% proof stress of 26.5 kgf/mm$^2$ or less.

The average austenite grain size specified by the relation with reduction ratio of finish cold-rolling, R, is obtained by annealing a hot-rolled sheet followed by cold-rolling and annealing in the temperature range of 860° to 950° C. for 0.5 to 2 min.

Figure 9:
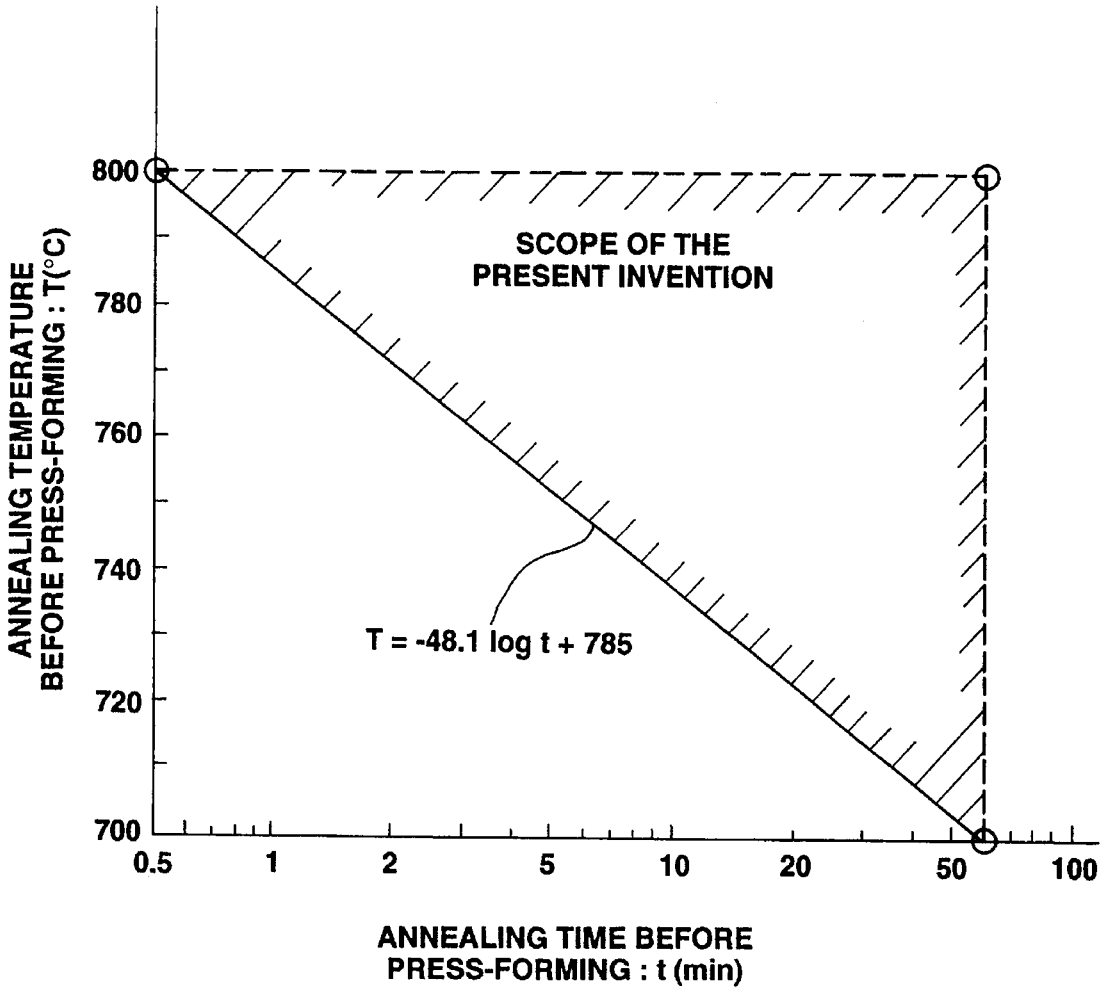
FIG. 9 is a graph showing a relationship among the condition of annealing before press-forming, 0.2% proof stress after the annealing before press-forming and the gathering degree of {211} plane according to the preferred embodiment-2.

FIG. 9 shows the relation among annealing temperature before press-forming (T), annealing time (t), 0.2% proof stress after annealing before press-forming and the gathering degree of {211} plane of an alloy sheet manufactured by the process including annealing of hot-rolled sheet in the temperature range of 910 to 990° C., cold-rolling, recrystallization annealing, finish cold-rolling, stress relief annealing and annealing before press-forming and by controlling the conditions such as chemical composition, annealing condition and reduction ratio of finish cold-rolling responding to the average austenite grain size before finish cold-rolling to satisfy the specification of present invention.

As clearly shown in FIG. 9, though the hot-rolled sheet annealing condition, austenite grain size before finish cold-rolling, and finish cold-rolling reduction ratio stay within the range specified in this invention and the temperature of annealing before press-forming has the relation of T<–53.8 log t+806, the satisfactory recrystallization is not conducted, 0.2% proof stress exceeds 27.5 kgf/mm$^2$ and the gathering degree of {211} plane exceeds 16%, which characteristic values do not satisfy the range specified in the present invention. When the temperature of annealing before press-forming, T, exceeds 800° C. or when the time of annealing before press-forming, t, exceeds 60 min., the gathering degree of {211} plane increases to higher than 16%, which is inadequate, also.

Consequently, to obtain the value of 0.2% proof stress and the gathering degree of {211} plane specified in the present invention, this invention specifies the temperature of annealing before press-forming, T (°C.), less than 800° C., and the annealing time, t, before press-forming, less than 60 min. and T>=–48.1 log t+785.

The annealing before press-forming of this invention may be carried before photo-etching. In that case, if the condition of annealing before press-forming is kept within the range specified in this invention, then a satisfactory photo-etching quality is secured. In concrete terms, the alloy that contains the chemical composition and has the gathering degree of the plane specified in the present invention can be etched after annealing before press-forming to obtain a good quality.

As for the alloy of prior art, there is no example that satisfies the conditions described above. Consequently, annealing before press-forming can not be conducted before photo-etching because the photo-etching after the annealing before press-forming following the conditions of this invention results in poor quality of photo-etching. There are other methods to limit the degree of {211} plane on the thin alloy sheet after the annealing before press-forming within the range specified in the present invention. Examples of these methods are quenching solidification and comprehensive structure control through the control of recrystallization during hot-working.

EXAMPLE 6

A series of ladle refining produced alloy of No 1 through No. 23 having the composition are shown in Table 15 and Table 16. Alloys of No. 1 through No. 13 and No. 18 through No. 23 were continuously casted into ingots. those continuously casted slabs were subjected to adjusting and hot-rolling (at 1100° C. for 3 hrs) to provide hot-rolled sheet. Alloys of No. 14 through No. 17 were directly casted into thin plates, these plates were hot-rolled at 40% of reduction ratio, then rolled at 700° C. to provide a hot-rolled sheet.

These hot-rolled sheets were subjected to annealing (at 930° C.), cold-rolling, recrystallization annealing, cold-rolling, recrystallization annealing (following the condition shown in Table 19), finish cold-rolling (at 21% of reduction ratio) and stress relief annealing to provide alloy sheets having 0.25 mm thickness. The hot-rolled sheet were fully recrystallized by hot-rolling. The alloy sheets were etched to make flat masks, which flat masks were then treated by the annealing before press-forming at 750° C. for 20 min. to provide material No. 1 through No. 23.

These were press-formed to inspect the press-formability. Table 15 and Table 16 shows the average austenite grain size before finish cold-rolling of each material, and Table 17 and Table 18 shows the gathering degree of {211} plane, tensile property and press-formability. The tensile property (0.2% proof stress and elongation perpendicular to the rolling direction) and gathering degree of {211} plane was inspected after annealing before press-forming. The tensile property was determined at room temperature. The measurement of degree of {211} plane was carried with X-ray diffraction method described before. The corrosion resistance were inspected after unstressing annealing.

As shown in Table 17 and Table 18, materials of No. 1 through No. 13, which have the chemical composition, gathering degree of {211} plane, and 0.2% proof stress within the range specified in the present invention, show excellent press-formability and corrosion resistance better than the comparative example described below. Materials of No. 1 through No. 17 of the present invention that includes Co also show excellent press-formability.

On the contrary, material No. 18 through No. 20 gives Si and Ni content above the upper limit of this invention and raises a problem in fitness to die. Material No. 18 gives corrosion resistance inferior to the material of the present invention. Material No. 19 gives O content above the upper limit of this invention and also gives 0.2% proof stress of more than 27.5 kgf/mm$^2$, the upper limit, which results in a poor shape fix ability and induces crack generation. Material No. 21 is the comparative example giving B content above the upper limit of this invention, which gives 0.2% proof stress above the upper limit of this invention, 27.5 kgf/mm$^2$, to degrade shape fix ability. These comparative materials gives gathering degree of {211} plane above the upper limit of the present invention to induce cracking of alloy sheet. Material No. 22 has the Cr content below the lower limit of the present invention. The average austenite grain size before finish cold-rolling of material No. 23 fails to reach the level that satisfies the reduction ratio of finish cold-rolling, which gives 0.2% proof stress of more than 27.5 kgf/mm$^2$ to degrade shape fix ability and induces crack generation.

The above discussion clearly shows that Fe—Ni—Cr alloy sheet and Fe—Ni—Co—Cr alloy having high press-formability aimed in the present invention is prepared by adjusting the chemical composition, gathering degree of {211} plane, and 0.2% proof stress within the range specified in this invention.

TABLE 15

| Material | | Chemical composition (wt. %) | | | | | | | | | Average austenite grain size before finish cold-rolling |
|---|---|---|---|---|---|---|---|---|---|---|---|
| No. | Alloy No. | Ni | Si | O | N | B | C | Mn | Cr | Co | (μm) |
| 1 | 1 | 35.8 | 0.005 | 0.0010 | 0.0008 | 0.00005 | 0.0013 | 0.25 | 1.00 | — | 18 |
| 2 | 2 | 36.1 | 0.02 | 0.0013 | 0.0011 | 0.0010 | 0.0011 | 0.26 | 0.30 | — | 17 |
| 3 | 3 | 36.2 | 0.03 | 0.0014 | 0.0011 | 0.0001 | 0.0015 | 0.04 | 0.60 | 0.003 | 17 |
| 4 | 4 | 36.5 | 0.04 | 0.0020 | 0.0015 | 0.0002 | 0.0040 | 0.30 | 1.20 | 0.600 | 15 |
| 5 | 5 | 35.8 | 0.01 | 0.0015 | 0.0010 | 0.0002 | 0.0029 | 0.27 | 0.05 | 0.010 | 14 |
| 6 | 6 | 35.8 | 0.01 | 0.0012 | 0.0009 | 0.0001 | 0.0029 | 0.27 | 2.00 | — | 15 |
| 7 | 7 | 36.0 | 0.02 | 0.0008 | 0.0008 | 0.0029 | 0.0009 | 0.11 | 2.12 | 0.050 | 14 |
| 8 | 8 | 36.2 | 0.05 | 0.0006 | 0.0005 | 0.0001 | 0.0008 | 0.05 | 2.70 | — | 12 |
| 9 | 9 | 36.4 | 0.001 | 0.0002 | 0.0002 | 0.0001 | 0.0005 | 0.005 | 1.53 | 0.532 | 13 |
| 10 | 10 | 35.5 | 0.04 | 0.0018 | 0.0012 | 0.0001 | 0.0032 | 0.01 | 0.53 | — | 12 |
| 11 | 11 | 35.9 | 0.03 | 0.0316 | 0.0012 | 0.00001 | 0.0030 | 0.20 | 0.82 | 0.001 | 20 |
| 12 | 12 | 35.9 | 0.05 | 0.0319 | 0.0013 | 0.00002 | 0.0050 | 0.30 | 0.95 | — | 22 |

TABLE 16

| Material | | Chemical composition (wt. %) | | | | | | | | | Average austenite grain size before finish cold-rolling |
|---|---|---|---|---|---|---|---|---|---|---|---|
| No. | Alloy No. | Ni | Si | O | N | B | C | Mn | Cr | Co | (μm) |
| 13 | 13 | 36.0 | 0.01 | 0.0017 | 0.0012 | 0.00001 | 0.0030 | 0.05 | 0.41 | 0.001 | 24 |
| 14 | 14 | 31.9 | 0.05 | 0.0021 | 0.0015 | 0.0023 | 0.0018 | 0.13 | 2.02 | 5.100 | 23 |
| 15 | 15 | 31.0 | 0.03 | 0.0014 | 0.0019 | 0.0005 | 0.0020 | 0.30 | 1.76 | 5.950 | 12 |
| 16 | 16 | 30.1 | 0.02 | 0.0017 | 0.0016 | 0.0002 | 0.0023 | 0.24 | 1.32 | 4.100 | 15 |
| 17 | 17 | 29.5 | 0.01 | 0.0016 | 0.0008 | 0.0015 | 0.0045 | 0.35 | 2.99 | 6.520 | 13 |
| 18 | 17 | 35.6 | 0.12 | 0.0020 | 0.0014 | 0.0002 | 0.0021 | 0.28 | 0.50 | — | 16 |
| 19 | 18 | 36.0 | 0.05 | 0.0035 | 0.0012 | 0.0001 | 0.0017 | 0.31 | 0.70 | — | 15 |
| 20 | 19 | 36.3 | 0.04 | 0.0018 | 0.0025 | 0.0002 | 0.0019 | 0.25 | 0.72 | — | 17 |
| 21 | 20 | 36.0 | 0.05 | 0.0018 | 0.0015 | 0.0035 | 0.0026 | 0.30 | 1.00 | 0.001 | 15 |
| 22 | 21 | 35.8 | 0.05 | 0.0023 | 0.0016 | 0.0001 | 0.0032 | 0.27 | 0.05 | 0.002 | 14 |
| 23 | 22 | 34.2 | 0.02 | 0.0020 | 0.0007 | 0.0010 | 0.0017 | 0.31 | 0.50 | 2.530 | 10 |

TABLE 17

| Material No. | Alloy No. | Corrosion resistance: Generation of spot rust (number/100 cm$^2$) | Tensile property*1: 0.2% proof stress (kgf/mm$^2$) | Tensile property*1: Elongation perpendicular to the rolling direction (%) | Gathering degree of {211} plane (%) | Press formability: Shape fix ability | Press formability: Fitnes to die | Press formability: Cracking on the alloy sheet |
|---|---|---|---|---|---|---|---|---|
| 1 | 1 | 2 | 27.0 | 42.2 | 9 | ◎ | o | None |
| 2 | 2 | 4 | 26.9 | 41.9 | 10 | ◎ | o | None |
| 3 | 3 | 3 | 26.9 | 42.0 | 11 | ◎ | o | None |
| 4 | 4 | 2 | 27.5 | 40.1 | 16 | o | o | None |
| 5 | 5 | 6 | 27.3 | 42.1 | 14 | o | o | None |
| 6 | 6 | 1 | 27.0 | 43.4 | 12 | ◎ | o | None |
| 7 | 7 | 1 | 26.7 | 41.2 | 16 | ◎ | o | None |
| 8 | 8 | 0 | 26.3 | 43.3 | 15 | ◎ | o | None |
| 9 | 9 | 1 | 25.8 | 43.8 | 14 | ◎ | o | None |
| 10 | 10 | 3 | 27.4 | 41.7 | 13 | o | o | None |
| 11 | 11 | 2 | 27.4 | 40.6 | 10 | o | o | None |
| 12 | 12 | 2 | 2727 | 42.8 | 8 | o | o | None |

TABLE 18

| Material No. | Alloy No. | Corrosion resistance: Generation of spot rust (number/100 cm$^2$) | Tensile property: 0.2% proof stress (kgf/mm$^2$) | Tensile property: Elongation perpendicular to the rolling direction (%) | Gathering degree of {211} plane (%) | Press formability: Shape fix ability | Press formability: Fitnes to die | Press formability: Cracking on the alloy sheet |
|---|---|---|---|---|---|---|---|---|
| 13 | 13 | 3 | 27.4 | 44.1 | 7 | o | o | None |
| 14 | 14 | 1 | 27.4 | 42.5 | 8 | o | o | None |
| 15 | 15 | 0 | 27.3 | 40.30 | 11 | o | o | None |
| 16 | 16 | 2 | 27.1 | 41.40 | 10 | o | o | None |
| 17 | 17 | 0 | 27.1 | 41.05 | 12 | o | o | None |
| 18 | 18 | 7 | 27.4 | 40.0 | 14 | o | x | None |
| 19 | 19 | 10 | 28.0 | 40.0 | 16 | Δ | o | Yes |
| 20 | 20 | 8 | 27.5 | 41.2 | 13 | o | x | None |
| 21 | 21 | 5 | 29.0 | 39.7 | 30 | x | o | Yes |
| 22 | 22 | 15 | 29.4 | 38.2 | 32 | x | o | Yes |
| 23 | 23 | 6 | 28.0 | 36.0 | 16 | x | o | Yes |

TABLE 19

| Material No. | Annealing condition |
|---|---|
| 1 | 890° C. × 1 min. |
| 2 | 890° C. × 1 min. |
| 3 | 890° C. × 1 min. |
| 4 | 880° C. × 0.8 min. |
| 5 | 880° C. × 0.8 min. |
| 6 | 880° C. × 0.8 min. |
| 7 | 880° C. × 0.8 min. |
| 8 | 870° C. × 1 min. |
| 9 | 870° C. × 1 min. |
| 10 | 870° C. × 1 min. |
| 11 | 910° C. × 1 min. |
| 12 | 920° C. × 0.5 min. |
| 13 | 930° C. × 0.5 min. |
| 14 | 920° C. × 0.5 min. |
| 15 | 870° C. × 1 min. |
| 16 | 880° C. × 0.8 min. |
| 17 | 870° C. × 1 min. |
| 18 | 890° C. × 1 min. |
| 19 | 890° C. × 1 min. |
| 20 | 890° C. × 1 min. |
| 21 | 890° C. × 1 min. |
| 22 | 890° C. × 1 min. |
| 23 | 890° C. × 1 min. |

EXAMPLE 7

Hot-rolled sheets of alloy No. 1, 9, and 14, which were used in Example 6, were employed. The annealing for hot-rolled sheet was applied to these materials under various annealing conditions given in Table 6, and no annealing was applied to one material which is also given in the table. They were subjected to cold-rolling, recrystallization annealing (at 890° C. for 1 min.), finish cold rolling (at 21% of reduction ratio), stress relief annealing to provide alloy sheet having 0.25 mm thickness. The flat masks were then treated by the annealing before press-forming at 750° C. for 15 min. to give materials No. 24 through No. 28. The flat masks were press-formed and were tested for press-formability. Table 20 shows the annealing temperature, average austenite grain size before finish cold-rolling and gathering degree of {211} plane. Table 21 shows tensile properties and press-formability. The method for measuring properties was the same as in Example 1.

As shown in Table 20 and 21, materials No. 24 and No. 25 having the chemical composition and satisfying the conditions specified in the present invention have excellent press-formability. On the contrary, materials No.26 through No. 28 give hot-rolled sheet annealing temperature above the limit of this invention, and all of these materials give the gathering degree of {211} plane above the upper limit of this invention and generate cracks on alloy sheet during press-forming. Furthermore, material No. 28 gives 0.2% proof stress of more than 27.2 kgf/mm$^2$ and raises problem of shape fix ability during press-forming. Consequently, to keep the degree of {211} plane within the range specified in this invention, it is important to carry the hot-rolled sheet annealing within the range specified in this invention.

TABLE 20

| Material No. | Alloy No. | Hot-rolled sheet annealing temperature (°C.) | Average austenite grain size before finish cold-rolling (μm) | Gathering degree of {211} plane (%) |
|---|---|---|---|---|
| 24 | 14 | 930 | 18 | 7 |
| 25 | 9 | 960 | 17 | 8 |
| 26 | 1 | 900 | 17 | 31 |
| 27 | 1 | 1000 | 18 | 35 |
| 28 | 1 | —* | 17 | 38 |

*Annealing of hot-rolled sheet was not applied

TABLE 21

| | Tensile property | | Material for press-forming | | |
|---|---|---|---|---|---|
| Material No. | 0.2% Proof stress (kfg/mm$^2$) | Elongation perpendicular to the rolling direction (%) | Shape fix ability | Fitness to die | Cracking on the alloy sheet |
| 24 | 27.2 | 42.1 | ⊚ | ○ | None |
| 25 | 26.9 | 42.2 | ⊚ | ○ | None |
| 26 | 27.4 | 37.5 | ○ | ○ | Yes |
| 27 | 27.5 | 38.1 | ○ | ○ | Yes |
| 28 | 27.7 | 35.12 | Δ | ○ | Yes |

EXAMPLE 8

Hot-rolled sheets of alloy No. 1, 2, 4, 6, 7, 8, 9, 11, 12, 13 and 14 which were used in Example 6 were employed. These hot-rolled sheet were subjected to the process including annealing (at 930° C.), cold-rolling, recrystallization annealing (at the temperature for 1 min. shown in Table 22 and Table 23), finish cold-rolling and stress relief annealing to obtain the alloy sheet having 0.25 mm thickness. The ahoy sheets were etched to make flat masks which flat masks were then subjected to annealing before press-forming at 750° C. for 20 min. to obtain material No. 29 through No. 66. These materials were press-formed to determine the press-formability. Table 22 and Table 23 shows the annealing temperature before finish cold-rolling, average austenite grain size before finish cold-rolling, reduction ratio of finishing cold rolling and tensile property. Table 10 and Table 11 shows the gathering degree of {211} plane and press-formability. The method for measuring properties was the same as in Example 1.

Table 22 through Table 25 shows that material No. 30 through No. 35, No. 38, No. 41 through 43 and No. 47 through 66, which have chemical composition and satisfy the conditions of hot-rolled sheet annealing and annealing before press-forming specified in the present invention and give the relation between average austenite grain size before finish cold-rolling and reduction ratio of finish cold-rolling in a region specified in the present invention, give {211} plane fo 16% or less. Of these, material No. 30, No. 35, No. 38, No. 41, No. 47, No. 49, No. 50, No. 54, No. 60, No. 63 and No. 66 employed reduction ratios of finish cold-rolling, R, (in the Region I in FIG. 8) satisfying the above described equations of (1a) and (1b) to give 0.2% proof stress of 27.5 kgf/mm$^2$or less. Material No. 31, No. 33, No. 34, No. 43, No. 48, No. 52, No. 55, No. 59 and No. 65 employed reduction ratios of finish cold-rolling, R, (in the Region II in FIG. 8) satisfying the above described equations of (2a) and (2b) to give 0.2% proof stress of 27.0 kgf/mm$^2$ or less. Material No. 32, No. 42, No. 51, No. 53, No. 56, No. 57, No. 58, No. 61, No. 62 and No. 64 employed reduction ratios of finish cold-rolling, R, (in the Region III in FIG. 8) satisfying the above described equations of (3a) and (3b) to give 0.2% proof stress of 26.5 kgf/mm$^2$ or less. All of these materials give 0.2% proof stress being aimed in this invention and show high press-forming quality. Accordingly, the decrease of 0.2% proof stress proved to increase the shape fix ability.

Contrary to the above preferable embodiment, the relation among the average austenite grain size before finish cold-rolling, conditions of hot-rolled sheet annealing and reduction ratio of finish cold-rolling of comparative materials of No. 29, No. 36, No. 37, No. 39, No. 40, No. 44, and No. 45 fails to satisfy the condition specified in the present invention even if they satisfy the condition of chemical composition, hot-rolled sheet annealing and annealing before press-forming specified in the present invention. They are out of scope of this invention for one of the 0.2% proof stress and the degree of {211} plane or both, and they raise problem of at least one of the shape fix ability and crack generation on alloy sheet during press-forming or both.

Material No. 64 was treated by the annealing before finish cold-rolling at 850° C. for 1 min. Such an annealing condition gives 10.0 μm of austenite grain size, so the 0.2% proof stress exceeds 27.5 kgf/mm$^2$ even if the finish cold-rolling reduction ratio is 15%. These figures can not provide a shape fix ability during press-forming which satisfies the specifications of this invention.

As discussed in detail thereabove, even under the condition that the chemical composition, condition of hot-rolled sheet annealing, and condition of the annealing before press-forming are kept in the range specified in this invention, it is important to keep the austenite grain size before finish cold-rolling and the reduction ratio of finishing cold-rolling within the range specified in this invention to obtain satisfactory press-formability being aimed by this invention.

TABLE 22

| Material No. | Alloy No. | Annealing temperature before finish cold-rolling (°C.) | Average austenite grain size before finish cold-rolling (μm) | Reduction ratio of finish cold-rolling (%) | Tensile property: 0.2% proof stress (kgf/mm²) | Tensile property: Elongation perpendicular to the rolling direction (%) |
|---|---|---|---|---|---|---|
| 29 | 1 | 890 | 18.0 | 10 | 29.2 | 30.4 |
| 30 | 1 | 890 | 18.0 | 16 | 27.5 | 40.2 |
| 31 | 1 | 890 | 18.0 | 21 | 27.0 | 42.0 |
| 32 | 1 | 890 | 18.0 | 30 | 26.3 | 40.3 |
| 33 | 1 | 890 | 18.0 | 50 | 26.7 | 41.4 |
| 34 | 1 | 890 | 18.0 | 50 | 27.0 | 40.8 |
| 35 | 1 | 890 | 18.0 | 60 | 27.4 | 42.8 |
| 36 | 1 | 890 | 18.0 | 70 | 28.0 | 30.5 |
| 37 | 2 | 860 | 11.0 | 21 | 27.6 | 35.5 |
| 38 | 1 | 920 | 23.3 | 21 | 27.3 | 40.6 |
| 39 | 1 | 930 | 26.5 | 21 | 28.0 | 35.0 |
| 40 | 2 | 860 | 11.0 | 50 | 27.4 | 40.0 |
| 41 | 1 | 880 | 16.4 | 50 | 27.4 | 42.0 |
| 42 | 1 | 920 | 23.3 | 50 | 25.8 | 41.6 |
| 43 | 1 | 930 | 26.5 | 50 | 26.8 | 43.2 |
| 44 | 1 | 940 | 32.5 | 50 | 28.5 | 37.8 |
| 45 | 1 | 920 | 23.3 | 78 | 28.1 | 37.2 |
| 46 | 8 | 850 | 10.0 | 15 | 29.1 | 30.5 |
| 47 | 2 | 860 | 11.0 | 16 | 27.5 | 40.0 |

TABLE 23

| Material No. | Alloy No. | Annealing temperature before finish cold-rolling (°C.) | Average austenite grain size before finish cold-rolling (μm) | Reduction ratio of finish cold-rolling (%) | Tensile property: 0.2% proof stress (kgf/mm²) | Tensile property: Elongation perpendicular to the rolling direction (%) |
|---|---|---|---|---|---|---|
| 48 | 6 | 870 | 14.0 | 22.5 | 27.0 | 41.4 |
| 49 | 6 | 870 | 14.0 | 30 | 27.3 | 41.5 |
| 50 | 6 | 870 | 14.0 | 37.5 | 27.5 | 43.1 |
| 51 | 1 | 880 | 16.5 | 26 | 26.5 | 43.0 |
| 52 | 1 | 880 | 16.5 | 40 | 27.0 | 44.0 |
| 53 | 1 | 890 | 18.0 | 35 | 26.4 | 41.6 |
| 54 | 12 | 910 | 20.0 | 74.5 | 27.5 | 40.6 |
| 55 | 14 | 910 | 21.0 | 21 | 26.9 | 41.7 |
| 56 | 11 | 910 | 21.0 | 26 | 26.5 | 42.3 |
| 57 | 11 | 910 | 21.0 | 30 | 26.2 | 41.4 |
| 58 | 11 | 910 | 21.0 | 53 | 26.4 | 40.3 |
| 59 | 11 | 910 | 21.0 | 68.5 | 27.0 | 41.1 |
| 60 | 9 | 865 | 13.0 | 17 | 27.4 | 42.1 |
| 61 | 9 | 920 | 23.3 | 40 | 26.5 | 41.6 |
| 62 | 9 | 920 | 23.3 | 62.5 | 26.4 | 41.5 |
| 63 | 13 | 930 | 26.5 | 40 | 27.3 | 41.7 |
| 64 | 13 | 930 | 26.5 | 60 | 26.5 | 41.8 |
| 65 | 7 | 935 | 29.8 | 69.5 | 26.9 | 41.6 |
| 66 | 4 | 940 | 32.5 | 74.5 | 27.5 | 40.2 |

TABLE 24

| Material No. | Alloy No. | Gathering: degree of {211} plane (%) | Press formability: Shape fix ability | Press formability: Fitness to die | Press formability: Cracking on the alloy sheet |
|---|---|---|---|---|---|
| 29 | 1 | 15 | x | ○ | Yes |
| 30 | 1 | 14 | ○ | ○ | None |
| 31 | 1 | 9 | ◎ | ○ | None |
| 32 | 1 | 14 | ◎ | ○ | None |
| 33 | 1 | 16 | ◎ | ○ | None |
| 34 | 1 | 13 | ◎ | ○ | None |
| 35 | 1 | 5 | ○ | ○ | None |
| 36 | 1 | 12 | x | ○ | Yes |

TABLE 24-continued

| Material No. | Alloy No. | Gathering: degree of {211} plane (%) | Press formability: Shape fix ability | Press formability: Fitness to die | Press formability: Cracking on the alloy sheet |
|---|---|---|---|---|---|
| 37 | 2 | 13 | Δ | ○ | Yes |
| 38 | 1 | 15 | ○ | ○ | None |
| 39 | 1 | 8 | x | ○ | Yes |
| 40 | 2 | 21 | x | ○ | None |
| 41 | 1 | 8 | ○ | ○ | None |
| 42 | 1 | 16 | ◎ | ○ | None |
| 43 | 1 | 5 | ◎ | ○ | None |
| 44 | 1 | 9 | x | ○ | Yes |

TABLE 24-continued

| Material No. | Alloy No. | Gathering degree of {211} plane (%) | Press formability: Shape fix ability | Press formability: Fitness to die | Press formability: Cracking on the alloy sheet |
|---|---|---|---|---|---|
| 45 | 1 | 26 | x | o | Yes |
| 46 | 8 | 20 | x | o | Yes |
| 47 | 2 | 14 | o | o | None |

TABLE 25

| Material No. | Alloy No. | Gathering degree of {211} plane (%) | Press formability: Shape fix ability | Press formability: Fitness to die | Press formability: Cracking on the alloy sheet |
|---|---|---|---|---|---|
| 48 | 6 | 13 | o | ⊙ | None |
| 49 | 6 | 10 | o | o | None |
| 50 | 6 | 5 | o | o | None |
| 51 | 1 | 3 | ⊙ | o | None |
| 52 | 1 | 3 | ⊙ | o | None |
| 53 | 1 | 15 | ⊙ | o | None |
| 54 | 1 | 16 | o | o | None |
| 55 | 12 | 9 | ⊙ | o | None |
| 56 | 14 | 9 | ⊙ | o | None |
| 57 | 11 | 12 | ⊙ | o | None |
| 58 | 11 | 13 | ⊙ | o | None |
| 59 | 11 | 16 | ⊙ | o | None |
| 60 | 9 | 7 | o | o | None |
| 61 | 9 | 13 | ⊙ | o | None |
| 62 | 9 | 16 | ⊙ | o | None |
| 63 | 13 | 13 | o | o | None |
| 64 | 13 | 15 | ⊙ | o | None |
| 65 | 7 | 15 | ⊙ | o | None |
| 66 | 4 | 16 | o | o | None |

EXAMPLE 9

Hot-rolled sheets of alloy No. 1, 4, 9, 10, 12, 14, 21 and 22 which were used in Example 1 were employed. These hot-rolled sheet were subjected to the process including annealing (at 930° C.), cold-rolling, recrystallization annealing (at 890° C. for 1 min.), finish cold-rolling (at 21% of reduction ratio) and stress relief annealing to obtain the alloy sheet having 0.25 mm thickness. The alloy sheets were etched to make flat masks, which flat masks were then subjected to annealing before press-forming under the conditions shown in Table 12 to obtain material No. 67 through No. 84. These materials were press-formed to determine the press-formability. Table 26 shows average austenite grain size before finish cold-rolling, condition of annealing before press-forming, gathering degree of {211} plane, tensile property and press-formability. Table 10 and Table 11 shows the gathering degree of {211} plane and press-formability. The method for measuring properties was the same as in Example 1.

Table 26 shows that material No. 67, No. 69, No. 70 and No. 76 through No. 84, which satisfy the conditions of chemical composition and hot-rolled sheet annealing, finish cold-rolling (reduction ratio of finish cold rolling), annealing before press-forming (temperature, time) specified in the present invention give the gathering degree of {211} plane of 16% or less. All of these materials give 0.2% proof stress being aimed in this invention and show high press-forming quality.

Contrary to the above preferable embodiment, comparative materials of No. 72 and No. 73 were annealed before press-forming at the temperature and for a time above the upper limit of the present invention though they satisfy the condition of chemical composition, hot-rolled sheet annealing and finish cold-rolling (reduction ratio of finish cold-rolling) specified in the present invention. They give 16% or more gathering degree of {211} plane and crackings are generated. Comparative material No. 63 was annealed before press-forming at a temperature of (T) and for a time of (t), that do not satisfy the equation of ($T \geqq -48.1 \log t + 785$). Comparative material No. 71 was annealed before press-forming for a time above the upper limit of the present invention and annealing temperature T and annealing time t do not satisfy the above described equation. All of these comparative materials give 0.2% proof stress of more than 27.5 kgf/mm$^2$, and they have problem in shape fix ability during press-forming. The degree of {211} plane of these materials exceed 16%, and cracks are generated on alloy sheet.

Materials of No. 74 and No. 75 employed comparative alloys. Even the annealing before press-forming is carried at 750° C. for 50 min., their 0.2% proof stress values exceed 27.5 kgf/mm$^2$ and they have problem in shape fix ability during press-forming. The gathering degree of {211} plane of these materials exceed 16%, and cracks are generated on alloy sheet.

As described in detail thereabove, even under the condition that the chemical composition, condition of hot-rolled sheet annealing and reduction ratio of finishing cold-rolling are kept in the range specified in this invention, it is important to keep the condition of annealing before press-forming within the range specified in this invention to obtain satisfactory press-form quality being aimed by this invention.

TABLE 26

| Material No. | Alloy No. | Average austenite grain size before finish cold-rolling (μm) | Condition of annealing before press forming: Temperature (°C.) | Condition of annealing before press forming: Time (min) | Gathering degree of {211} plane (%) | Tensile property: 0.2% proof stress (kgf/mm$^2$) | Tensile property: Elongation perpendicular to the rolling direction (%) | Press formability: Shape fix ability | Press formability: Fitnes to die | Press formability: Cracking on the alloy sheet |
|---|---|---|---|---|---|---|---|---|---|---|
| 67 | 1 | 18 | 730 | 30 | 13 | 27.4 | 40.8 | o | o | None |
| 68 | 1 | 18 | 750 | 5 | 23 | 28.4 | 40.0 | x | o | Yes |
| 69 | 1 | 18 | 750 | 20 | 8 | 26.9 | 42.1 | ⊙ | o | None |
| 70 | 1 | 13 | 790 | 2 | 15 | 27.4 | 41.0 | o | o | None |
| 71 | 1 | 18 | 700 | 60 | 28 | 27.6 | 37.4 | Δ | o | Yes |

TABLE 26-continued

| Material No. | Alloy No. | Average austenite grain size before finish cold-rolling (μm) | Condition of annealing before press forming: Temperature (°C.) | Condition of annealing before press forming: Time (min) | Gathering degree of {211} plane (%) | Tensile property: 0.2% proof stress (kgf/mm²) | Tensile property: Elongation perpendicular to the rolling direction (%) | Press formability: Shape fix ability | Press formability: Fitnes to die | Press formability: Cracking on the alloy sheet |
|---|---|---|---|---|---|---|---|---|---|---|
| 72 | 1 | 18 | 810 | 2 | 36 | 26.7 | 34.7 | ◎ | ○ | Yes |
| 73 | 1 | 17 | 750 | 65 | 20 | 26.5 | 37.1 | ◎ | ○ | Yes |
| 74 | 21 | 16 | 750 | 50 | 31 | 27.9 | 37.2 | Δ | Δ | Yes |
| 75 | 19 | 14 | 750 | 50 | 16 | 28.2 | 37.9 | x | ○ | Yes |
| 76 | 10 | 16.5 | 790 | 10 | 8 | 26.9 | 43.2 | ◎ | ○ | Yes |
| 77 | 1 | 18 | 790 | 40 | 16 | 26.0 | 40.0 | ◎ | ○ | None |
| 78 | 12 | 17 | 770 | 5 | 13 | 27.3 | 40.2 | ○ | ○ | None |
| 79 | 12 | 17 | 770 | 15 | 8 | 26.5 | 43.0 | ◎ | ○ | None |
| 80 | 14 | 17 | 770 | 40 | 16 | 26.3 | 42.2 | ◎ | ○ | None |
| 81 | 1 | 18 | 750 | 11 | 16 | 27.5 | 40.4 | ○ | ○ | None |
| 82 | 1 | 18 | 750 | 40 | 16 | 26.6 | 40.8 | ◎ | ○ | None |
| 83 | 9 | 19 | 740 | 18 | 11 | 27.1 | 42.4 | ○ | ○ | None |
| 84 | 4 | 15 | 720 | 40 | 15 | 27.5 | 40.4 | ○ | ○ | None |

EXAMPLE 10

Hot-rolled sheets of alloy No. 1 and No. 4, which were used in Example 1, were employed. These sheets were subjected to annealing (at 930° C.), cold-rolling, recrystallization annealing, cold rolling, recrystallization annealing (at 890° C. for 1 min.), finish cold-rolling (at 21% of reduction ratio) and stress relief annealing to obtain alloy sheets having 0.25 mm thickness. These alloy sheets were annealed before press-forming under the conditions shown in Table 27 to obtain material No. 85 through No. 87. The alloy sheets were etched to make flat masks. The press-forming was applied to these flat masks then the press-formability was determined. Table 13 shows the average austenite grain size, condition of annealing before press-forming and gathering degree of {211} plane of each material. Table 28 shows the tensile property, press-formability and etching performance. Etching performance was determined by visual observation of irregularity appeared on the etched flat masks. The measuring method for each property was the same as in Example 6.

Table 27 and Table 28 indicate that materials of No. 85 through No. 87 which satisfy the condition of chemical composition and manufacturing process specified in the present invention give favorable state without irregularity in etching, 16% or less of the degree of {211} plane, and 0.2% proof stress within the range specified in this invention. All of these materials show excellent press-form quality.

Therefore, it is important to keep the chemical composition and manufacturing process specified in this invention to obtain satisfactory press-formability being aimed by this invention. If these conditions are satisfied, an alloy sheet subjected to etching after the annealing before press-forming gives a flat mask having the desired etching performance free of irregularity.

TABLE 27

| Material No. | Alloy No. | Average austenite grain size before finish cold-rolling (μm) | Annealing condition before press-forming: Temperature (°C.) | Annealing condition before press-forming: Time (min.) | Gathering degree of {211} plane (%) |
|---|---|---|---|---|---|
| 85 | 1 | 18 | 750 | 20 | 8 |
| 86 | 1 | 17 | 790 | 2 | 16 |
| 87 | 4 | 13 | 720 | 40 | 15 |

TABLE 28

| Material No. | Tensile property: 0.2% proof strength (kgf/mm²) | Tensile property: Elongation perpendicular to the rolling direction (%) | Press-formability: Shape fix ability | Press-formability: Fitness to die | Press-formability: Cracking on the alloy sheet | Etching performance |
|---|---|---|---|---|---|---|
| 85 | 26.9 | 42.6 | ◎ | ○ | None | No irregularity |
| 86 | 27.5 | 41.3 | ○ | ○ | None | No irregularity |
| 87 | 27.5 | 4.04 | ○ | ○ | None | No irregularity |

As described in detail in Example 6 through Example 10, the alloy sheets having higher than 16% of the gathering degree of {211} plane give lower elongation perpendicular to rolling direction after the annealing before press-forming than that of the preferred embodiment of this invention. Increased gathering degree of {211} plane presumably decreases the elongation and induces cracks on alloy sheet during press-forming.

What is claimed is:

1. An annealed alloy sheet for making a shadow mask by press forming the annealed alloy sheet, said alloy sheet consisting essentially of 34 to 38 wt. % Ni, 0.07 wt. % or less Si, 0.00001 to 0.002 wt. % B, 0.002 wt. % or less O, less than 0.002 wt. % N and optionally C, Mn and Cr, with the balance being Fe and inevitable impurities;

said annealed alloy sheet having the following properties:

(i) 0.2% proof stress of 28 kgf/mm$^2$ or less; and (ii) a gathering degree of {211} plane of said annealed alloy sheet being 16% or less.

2. The annealed alloy sheet of claim 1, wherein said Ni content is 35 to 37 wt. %.

3. The annealed alloy sheet of claim 2, wherein said Ni content is 35.5 to 36.5 wt. %.

4. The annealed alloy sheet of claim 1, wherein said Si content is 0.001 to 0.07 wt. %.

5. The annealed alloy sheet of claim 1, wherein said O content is 0.001 to 0.002 wt. %.

6. The annealed alloy sheet of claim 1, wherein said N content is 0.0001 to 0.002 wt. %.

7. The annealed alloy sheet of claim 1, wherein said 0.2% proof stress is 27.5 kgf/mm$^2$ or less.

8. The alloy sheet of claim 7, wherein said 0.2% proof stress is 27 kgf/mm$^2$ or less.

9. The annealed alloy sheet of claim 1, wherein said Ni content is 35.5 to 36.5 wt. %;

said Si content is 0.001 to 0.07 wt. %;

said O content is 0.001 to 0.002 wt. %; and said N content is 0.0001 to 0.002 wt. %.

10. An annealed alloy sheet for making a shadow mask by press forming the annealed alloy sheet, said alloy sheet consisting essentially of:

34 to 38 wt. % Ni, 0.07 wt. % or less Si, 0.002 wt. % or less B, 0.002 wt. % or less O, less than 0.002 wt. % N, 0.001 to 1 wt. % Co and optionally C, Mn and Cr, with the balance being Fe and inevitable impurities;

said annealed alloy sheet having the following properties:

(i) 0.2% proof stress of 28 kgf/mm$^2$ or less; and (ii) a gathering degree of {211} plane of said annealed alloy sheet being 16% or less.

11. The annealed alloy sheet of claim 10, wherein said Ni content is to 37 wt. %.

12. The annealed alloy sheet of claim 11, wherein said Ni content is 35.5 to 36.5 wt. %.

13. The annealed alloy sheet of claim 10, wherein said Si content is 0.001 to 0.07 wt. %.

14. The annealed alloy sheet of claim 10, wherein said O content is 0.001 to 0.002 wt. %.

15. The annealed alloy sheet of claim 10, wherein said N content is 0.0001 to 0.002 wt. %.

16. The annealed alloy sheet of claim 10, said Co content is 0.001 to 1 wt. %.

17. The annealed alloy sheet of claim 10, wherein said 0.2% proof stress is 27.5 kgf/mm$^2$ or less.

18. The annealed alloy sheet of claim 17, wherein said 0.2% proof stress is 27 kgf/mm$^2$ or less.

19. The annealed alloy sheet of claim 10, wherein said Ni content is 35.5 to 36.5 wt. %;

said Si content is 0.001 to 0.07 wt. %;

said O content is 0.001 to 0.002 wt. %;

said N content is 0.0001 to 0.002 wt. %; and said Co content is 0.001 to 1 wt. %.

20. An annealed alloy sheet for making a shadow mask by press forming the annealed alloy sheet, said alloy sheet consisting essentially of 28 to 38 wt. % Ni, 0.07 wt. % or less Si, 0.002 wt. % or less B, 0.002 wt. % or less O, less than 0.002 wt. % N, over 1 wt. % Co to 7 wt. % Co and the balance being Fe and inevitable impurities;

said annealed alloy sheet having the following properties:

(i) 0.2% proof stress of 28 kgf/mm$^2$ or less; and (ii) a gathering degree of {211} plane of said annealed alloy sheet being 16% or less.

21. The annealed alloy sheet of claim 20, wherein said Ni content is 30 to 33 wt. %.

22. The annealed alloy sheet of claim 20, wherein said Co content is 3 to 6 wt. %.

23. The annealed alloy sheet of claim 20, wherein said Ni content is 30 to 33 wt. %; and said Co content is 3 to 6 wt. %.

24. The annealed alloy sheet of claim 20, wherein said Si content is 0.001 to 0.07 wt. %.

25. The annealed alloy sheet of claim 20, wherein said O content is 0.001 to 0.002 wt. %.

26. The annealed alloy sheet of claim 20, wherein said N content is 0.0001 to 0.002 wt. %.

27. The annealed alloy sheet of claim 20, wherein said 0.2% proof stress is 27.5 kgf/mm$^2$ or less.

28. The annealed alloy sheet of claim 27, wherein said 0.2% proof stress is 27 kgf/mm$^2$ or less.

29. The annealed alloy sheet of claim 20, wherein said Ni content is 30 to 33 wt. %;

said Co content is 3 to 6 wt. %;

said Si content is 0.001 to 0.07 wt. %;

said O content is 0.001 to 0.002 wt. %; and said N content is 0.0001 to 0.002 wt. %.

30. An annealed alloy sheet for making a shadow mask by press forming the annealed alloy sheet, said alloy sheet consisting essentially of 34 to 38 wt. % Ni, 0.1 wt. % or less Si, 0.00001 to 0.003 wt. % or less B, 0.003 wt. % or less O, less than 0.002 wt. % N, 0.05 to 3 wt. % Cr and the balance being Fe and inevitable impurities;

said annealed alloy sheet having the following properties:

(i) 0.2% proof stress of 27.5 kgf/mm$^2$ or less; and (ii) a gathering degree of {211} plane of said annealed alloy sheet being 16% or less.

31. The annealed alloy sheet of claim 30, wherein said Ni content is 35 to 37 wt. %.

32. The annealed alloy sheet of claim 31, wherein said Ni content is 35.5 to 36.5 wt. %.

33. The annealed alloy sheet of claim 30, wherein said Si content is 0.001 to 0.1 wt. %.

34. The annealed alloy sheet of claim 30, wherein said O content is 0.001 to 0.003 wt. %.

35. The annealed alloy sheet of claim 30, wherein said N content is 0.0001 to 0.002 wt, %.

36. The annealed alloy sheet of claim 30, wherein said 0.2% proof stress is 27 kgf/mm$^2$ or less.

37. The annealed alloy sheet of claim 36, wherein said 0.2% proof stress is 26.5 kgf/mm$^2$ or less.

38. The annealed alloy sheet of claim 30, wherein said Ni content is 35.5 to 36.5 wt. %;

said Si content is 0.001 to 0.1 wt. %;

said O content is 0.001 to 0.003 wt. %; and said N content is 0.0001 to 0.002 wt. %.

39. An annealed alloy sheet for making a shadow mask by press-forming the alloy sheet, said annealed alloy sheet consisting essentially of 34 to 38 wt. % Ni, 0.1 wt. % or less Si, 0.00001 to 0.003 wt. % B, 0.003 wt. % or less O, less than 0.002 wt. % N, 0.05 to 3 wt. % Cr, 1 wt. % or less Co and the balance being Fe and inevitable impurities;

said annealed alloy sheet having the following properties:

(i) 0.2% proof stress of 27.5 kgf/mm$^2$ or less; and (ii) a gathering degree of {211} plane of said annealed alloy sheet being 16% or less.

40. The annealed alloy sheet of claim 39, wherein said Ni content is 35 to 37 wt. %.

41. The annealed alloy sheet of claim 40, wherein said Ni content is 35.5 to 36.5 wt. %.

42. The annealed alloy sheet of claim 39, wherein said Si content is 0.001 to 0.1 wt. %.

43. The annealed alloy sheet of claim 39, wherein said O content is 0.001 to 0.003 wt. %.

44.The annealed alloy sheet of claim 39, wherein said N content is 0.0001 to 0.002 wt. %.

45. The annealed alloy sheet of claim 39, wherein said 0.2% proof stress is 27 kgf/mm$^2$ or less.

46. The annealed alloy sheet of claim 45, wherein said 0.2% proof stress is 26.5 kgf/mm$^2$ or less.

47. The annealed alloy sheet of claim 39, wherein said Ni content is 35.5 to 36.5 wt. %;

said Si content is 0.001 to 0.1 wt. %;

said O content is 0.001 to 0.003 wt. %; and said N content is 0.0001 to 0.002 wt. %.

48. An annealed alloy sheet for making a shadow mask by press forming the annealed alloy sheet, said alloy sheet consisting essentially of 28 to 38 wt. % Ni, 0.1 wt. % or less Si, 0.003 wt. % or less B, 0.003 wt. % or less O, less than 0.002 wt. % N, 0.05 to 3 wt. % Cr, over 1 wt. % Co to 7 wt. % Co and the balance being Fe and inevitable impurities;

said annealed alloy sheet having the following properties:

(i) 0.2% proof stress of 27.5 kgf/mm$^2$ or less; and (ii) a gathering degree of {211} plane of said annealed alloy sheet being 16% or less.

49. The annealed alloy sheet of claim 48, wherein said Ni content is 30 to 33 wt. %.

50. The annealed alloy sheet of claim 48, wherein said Co content is 3 to 6 wt. %.

51. The annealed alloy sheet of claim 48, wherein said Ni content is 30 to 33 wt. %; and said Co content is 3 to 6 wt. %.

52. The annealed alloy sheet of claim 48, said Si content is 0.001 to 0.1 wt. %.

53. The annealed alloy sheet of claim 48, wherein said O content is 0.001 to 0.003 wt. %.

54. The annealed alloy sheet of claim 48, wherein said N content is 0.0001 to 0.002 wt. %.

55. The annealed alloy sheet of claim 48, wherein said 0.2% proof stress is 27 kgf/mm$^2$ or less.

56. The annealed alloy sheet of claim 55, wherein said 0.2% proof stress is 26.5 kgf/mm$^2$ or less.

57. The annealed alloy sheet of claim 48, wherein said Ni content is 30 to 33 wt. %;

said Co content is 3 to 6 wt. %;

said Si content is 0.001 to 0.1 wt. %;

said O content is 0.001 to 0.003 wt. %; and said N content is 0.0001 to 0.002 wt. %.

58. The annealed alloy sheet of claim 1, further containing 0.0001 to 0.005 wt. % C.

59. The annealed alloy sheet of claim 1, further containing 0.001 to 0.35 wt. % Mn.

60. The annealed alloy sheet of claim 1, further containing 0.001 to 0.05 wt. % Cr.

61. The annealed alloy sheet of claim 1, further containing 0.0001 to 0.005 wt. % C, 0.001 to 0.35 wt. % Mn and 0.001 to 0.05 wt. % Cr.

62. The annealed alloy sheet of claim 1, wherein the 0.2 proof stress is 26.3 to 28 kgf/mm$^2$.

63. The annealed alloy sheet of claim 1, wherein the gathering degree of the {211} plane is 2 to 16%.

64. The annealed alloy sheet of claim 10, further containing 0.0001 to 0.005 wt. % C.

65. The annealed alloy sheet of claim 10, further containing 0.001 to 0.35 wt. % Mn.

66. The annealed alloy sheet of claim 10, further containing 0.001 to 0.05 wt. % Cr.

67. The annealed alloy sheet of claim 10, further containing 0.0001 to 0.005 wt. % C, 0.001 to 0.35 wt. % Mn and 0.001 to 0.05 wt. % Cr.

68. The annealed alloy sheet of claim 10, wherein the B is in an amount of 0.00001 to 0.002 wt. %.

69. The alloy sheet of claim 20, wherein the B is in an amount of 0.00001 to 0.002 wt. %.

70. The annealed alloy sheet of claim 48, wherein the B is in an amount of 0.00001 to 0.003 wt. %.

71. The annealed alloy sheet of claim 30, wherein the Cr is in an amount of 0.3 to 3 wt. %.

72. The annealed alloy sheet of claim 39, wherein the Cr is in an amount of 0.3 to 3 wt. %.

* * * * *

UNITED STATES PATENT AND TRADEMARK OFFICE

CERTIFICATE OF CORRECTION

PATENT NO. : 5,620,535
DATED : April 15, 1997
INVENTOR(S) : INOUE et al It is certified that error appears in the above-identified patent and that said Letters Patent is hereby corrected as shown below:

Column 39, line 52 (Claim 11): after "is"
insert --35--.

Signed and Sealed this

Twenty-third Day of February, 1999

*Attest:*

Q. TODD DICKINSON

*Attesting Officer*

*Acting Commissioner of Patents and Trademarks*